US006966544B2

(12) United States Patent
McCormick et al.

(10) Patent No.: US 6,966,544 B2
(45) Date of Patent: Nov. 22, 2005

(54) HOIST APPARATUS

(75) Inventors: Stephen J. McCormick, Shorewood, WI (US); Joseph M. Plasz, Grafton, WI (US); Mark E. Ubl, Oak Creek, WI (US); Phillip J. Bartelme, West Allis, WI (US); Neal W. Becker, Greenfield, WI (US)

(73) Assignee: MHE Technologies, Inc., Wilmington, DE (US)

( * ) Notice: Subject to any disclaimer, the term of this patent is extended or adjusted under 35 U.S.C. 154(b) by 81 days.

(21) Appl. No.: 10/380,149

(22) PCT Filed: Oct. 18, 2001

(86) PCT No.: PCT/US01/32612

§ 371 (c)(1),
(2), (4) Date: Mar. 12, 2003

(87) PCT Pub. No.: WO02/32800

PCT Pub. Date: Apr. 25, 2002

(65) Prior Publication Data

US 2003/0205703 A1 Nov. 6, 2003

Related U.S. Application Data

(60) Provisional application No. 60/241,530, filed on Oct. 18, 2000.

(51) Int. Cl.[7] ..... B66D 1/24; B66D 1/00

(52) U.S. Cl. ..... 254/342; 254/344; 254/345; 74/801

(58) Field of Search ..... 254/342, 344, 254/345; 74/801

(56) References Cited

U.S. PATENT DOCUMENTS

| | | | | |
|---|---|---|---|---|
| 1,101,595 A | | 6/1914 | Walles | |
| 1,310,275 A | | 7/1919 | Brown | |
| 3,948,488 A | * | 4/1976 | Brockelsby | 254/323 |
| 3,994,476 A | | 11/1976 | van Gennep | |
| 4,175,727 A | | 11/1979 | Clarke | |
| 4,257,577 A | * | 3/1981 | Eriksson et al. | 254/344 |
| 4,434,972 A | | 3/1984 | Charles | |
| 6,113,023 A | | 9/2000 | Ueffing et al. | |
| 6,135,421 A | | 10/2000 | Bartelme et al. | |
| 6,152,425 A | | 11/2000 | Boyer | |
| 6,241,215 B1 | | 6/2001 | Gersemsky et al. | |

* cited by examiner

*Primary Examiner*—Kathy Matecki
*Assistant Examiner*—Evan Langdon
(74) *Attorney, Agent, or Firm*—Michael Best & Friedrich LLP

(57) ABSTRACT

The invention relates to a hoist apparatus including at least one of a three-part double reeved bottom block that has the same height profile as a two-part bottom block and the same lifting capacity as a three-part bottom block that includes an integral equalizer sheave nest, a device for limiting the rotation of a hoist drum beyond a desired position, a hybrid gear box adapted for use on two different categories and/or types of hoist apparatuses through the use of an adapter plate that permits coupling of the gearbox to the hoist drum of the hoist apparatus in a plurality of configurations and an external ring gear that results in a second output torque and speed of the gearbox, a self-lubricating load braking assembly having lubrication inlet holes and lubrication outlet holes for pumping lubrication into and out of the load brake assembly, a gearbox for use on the hoist apparatus including a two-stage high gear ratio gear set and a load brake assembly, a controller configured to acquire operational data representative of the hoist apparatus and generate an output indicative of a remaining useful life of the hoist apparatus, and an inverter controller configured to control verify load integrity and prevent possible load loss without the use of a load brake assembly and/or an encoder or similar feedback device.

16 Claims, 21 Drawing Sheets

HOIST APPARATUS

RELATED APPLICATIONS

This application claims the benefit of prior filed co-pending U.S. provisional patent application No. 60/241,530, entitled Hoist Improvements, filed on Oct. 18, 2000.

BACKGROUND OF THE INVENTION

The invention relates to a hoist apparatus, and more particularly to a new and useful hoist apparatus and method of operating the same.

A conventional hoist apparatus includes a hoist drum, a hoist motor for selectively rotating the hoist drum, and a hoist rope wound around the hoist drum such that the hoist rope winds on to and off of the hoist drum in response to rotation of the hoist drum in opposite directions. Typically, the hoist rope is wire rope and the hoist drum has a helical groove in which the hoist rope is reeved as the hoist rope winds on to the hoist drum. A bottom block is supported by the hoist rope such that the bottom block moves up and down as the hoist rope winds on to and off of the hoist drum.

SUMMARY OF THE INVENTION

Hoist apparatuses are generally configured-to meet lifting requirements for a particular range of lifting applications. The lifting requirements depend upon a number of factors including the weight of the load that is to be lifted, the speed at which the load is to be lifted, the frequency at which the load is to be lifted (i.e., how often the hoist apparatus is utilized to lift the load), and the like. The combination of the bottom block the hoist apparatus utilizes and the reeving configuration the hoist rope employs to support the bottom block makes up one facet of a configuration of the hoist apparatus. The combination of a bottom block and a reeving configuration can be selected from a number of different bottom blocks and a number of different reeving configurations. A three-part bottom block and a double reeving configuration is one such combination.

Typically, a three-part bottom block includes an integral equalizer sheave nest that extends from the top of the thee part bottom block causing the three-part bottom block to be quite large. The overall height profile of a bottom block cuts down on the headroom of the hoist apparatus the bottom block is utilized on (i.e., how high the bottom block can raise with respect to the structure of the hoist apparatus). Based on the lifting requirements of a particular lifting application, it may be desirous to utilize a three-part bottom block. However, headroom of the hoist apparatus for the particular lifting application may only allow for use of a bottom block sized generally similar to or smaller than a two part bottom block. Commonly, the only option available is to utilize a bottom block that is sized generally similar to or smaller than a two part bottom block and then alter some other facet of the configuration of the hoist apparatus to meet the lifting requirements for the particular application. Alteration of other facets of the configuration of the hoist apparatus, for example using a larger hoist motor and/or a more durable gearbox, may result in higher costs associated with acquiring a hoist apparatus when compared with the costs associated with acquiring a hoist apparatus that only uses a three-part bottom block (i.e., the hoist apparatus does not include parts corresponding to alteration of other facets).

Accordingly, in one embodiment the invention provides a three-part bottom block that includes a height profile that is substantially similar to a similarly configured two part bottom block. The three-part bottom block of the invention effectively reduces the dead space through which a load cannot be lifted. The invention eliminates the need for an integral equalizer sheave nest on the three-part bottom block of the hoist apparatus. The hoist rope equalization function typically performed by the equalizer sheave nest is handled in the invention by selective placement of the hoist rope ends on the hoist drum. Hoist rope clips are utilized to provide selective placement of the hoist rope ends on the hoist drum. When reeving the hoist apparatus, the hoist rope ends are selectively placed so that the bottom block is supported by the hoist rope such that the cross shaft of the bottom block is horizontal (i.e., the length of each part of the hoist rope is equalized). Once the parts of the hoist rope are equalized, the hoist rope clips locks the hoist rope in to place.

When the hoist rope is reeved the end of the hoist rope opposite the end of the hoist rope that is selectively placed on the hoist drum is dead-ended on the three-part bottom block of the invention to achieve a lifting capacity that is substantially similar to a similarly configured three-part bottom block that includes an integral equalizer sheave nest. In one embodiment the three-part bottom block is a three-part double reeved bottom block.

In order to prevent a load or the bottom block from being raised too high, to prevent the hoist rope from paying out too far, and/or to prevent the load from being lowered too low, it is known to provide a limit switch for preventing the hoist rope from being wound too far on to or off of the hoist drum. Such a limit switch may include a geared limit switch. A geared limit switch operates by counting the revolutions of the hoist drum. When a threshold number of revolutions is reached, a cam or gear actuates a switch (e.g., a microswitch) that cuts power to the hoist motor. The switch that is utilized to cut power to the hoist motor generally includes many parts that can fail and/or wear out. Additionally, the geared limit switch may be ineffective in detecting when hoist rope piles up and/or over wraps on the hoist drum (i.e., revolutions of the hoist drum do not correspond to the actual length of hoist rope wound on to or off of the hoist drum) thereby causing the switch to cut power at inappropriate times.

Accordingly, in another embodiment the invention provides a proximity limit switch that is utilized to detect when the hoist drum needs to be stopped. The proximity limit switch of the invention is disclosed in U.S. Pat. No. 6,135,421, entitled "Hoist With Proximity Limit Switch." The proximity limit switch is adjustably fixed or mounted on the hoist apparatus adjacent the hoist drum such that the hoist drum rotates relative to the proximity limit switch. The proximity limit switch is operable to prevent the hoist motor from rotating the hoist drum in a given direction when the proximity limit switch senses the presence or absence of the hoist rope, depending upon the direction of the hoist drum rotation. If the hoist rope is being would on to the hoist drum properly, the point at which the hoist rope leaves the groove of the hoist drum is always the same when a selected length of hoist rope is wound on to the hoist drum. It is therefore possible to have the proximity limit switch "look for" the hoist rope at a certain point in the groove or along the hoist drum. If the proximity limit switch is preventing the hoist rope from winding too far on to the hoist drum, the proximity limit switch stops the hoist drum in response to the presence of the hoist rope at a selected position in the groove. If the proximity limit switch is preventing the hoist rope from winding too far off of the hoist drum, the proximity limit switch stops the hoist drum in response to the absence of the hoist rope at a different selected position in the groove.

Hoist apparatuses generally also include a gearbox that couples the hoist motor to the hoist drum. The gearbox includes a gear set that transfers the torque and speed of the hoist motor output to a torque and speed that is utilized to drive the hoist drum. An output shaft of the gearbox is coupled to the hoist drum to selectively rotate the hoist drum at the output torque and speed of the gearbox. Based upon the lifting requirements of a lifting application, a particularly sized hoist apparatus is selected. Different categories of hoist apparatuses exist (e.g., H1–H5) that are intended for use in different ranges of lifting application. The different categories of hoist apparatuses vary greatly in the loads that can be lifted, the speeds at which the loads can be lifted, and the frequency at which the loads can be lifted. A first lifting application may require a heavy load to be lifted once per year (e.g., to perform maintenance on a utility generator). A second lifting application may require a lighter load to be lifted many times per shift, three shifts per day, every day of the year (e.g., lifting parts out of a press at a manufacturing operation). Obviously, the speed of the second lifting application is much more important than the speed of the first lifting application. Each lifting application likely requires a different category of hoist apparatus. Generally, each category of hoist apparatus requires a different gearbox that produces the necessary torque and speed to drive the hoist drum. The time and expenses associated with developing and supplying a large number of different gearboxes is not efficient for a hoist apparatus provider.

Accordingly, in another embodiment the invention provides a hybrid gearbox that can be utilized on a number of different categories and/or types of hoist apparatus. An adapter plate and an external ring gear allow the hoist apparatus provider to quickly and efficiently transform the output torque and speed of the gearbox to a second output torque and speed of the gearbox. The second output torque and speed can be utilized on a category and/or a type of hoist apparatus that meets higher lifting requirements. In a first embodiment of the hybrid gearbox, the gearbox is coupled to the hoist drum as is conventionally known. In another embodiment of the hybrid gearbox, the ring gear is coupled to the hoist drum and the adapter plate is coupled to the gear box. The adapter plate allows for mounting of the assembly of the adapter plate and the gearbox to the frame in a plurality of orientations with respect to the axis of travel of the bottom block, thereby allowing the hoist apparatus provider to utilize a single gearbox for a number of different types of hoist apparatuses. For example, the gearbox can be mounted in a parallel configuration (i.e., parallel with the travel of the bottom block) or in a cross mounted configuration (i.e., perpendicular to the travel of the bottom block) using a single assembly of the adapter plate and the gearbox. In other embodiments, the gearbox may be mounted at any position there between. Use of the adapter plate to mount the gearbox in different configurations also eliminates the need for different frame configurations for different types of hoist apparatuses.

In each orientation the assembly of the adapter plate and the gearbox is mounted an output pinion that is coupled to the output shaft of the gearbox is aligned to mesh with the ring gear and thereby selectively drive the hoist drum. The addition of the external ring gear results in an overall gear ratio that produces an output of the gearbox (i.e., wherein the ring gear is considered to be part of the gear set of the gearbox) that includes more torque and less speed in most embodiments.

A load brake assembly is commonly used in a gearbox of a hoist apparatus to ensure load integrity and/or stability. The load brake assembly is used to provide a fail-safe hoist apparatus (i.e., if the hoist motor and other brakes associated with the hoist apparatus all fail at the same time the load brake assembly sets and holds the load suspended). The load brake assembly does not brake when the hoist drum is rotated in the wind-on direction. When the hoist drum is rotated in the wind-off direction the load brake assembly may be utilized to provide smooth lowering of the load. The load brake can be set to stop and/or slow the hoist rope from being wound off of the hoist drum. A Weston style load brake is generally known in the art. The nature of the Weston style load brake is such that large quantities of frictional heat are produced during the braking process. If the heat produced is not quickly dissipated to the oil sump of the gearbox, the frictional surfaces of the load brake assembly may glaze and thereby lose functionality.

Accordingly, in another embodiment the invention provides a self-lubricating load brake assembly. Lubrication inlet holes are utilized to pump "fresh" or cool lubrication into the load brake assembly to thereby remove beat from the frictional surfaces of the load brake assembly. Lubrication is pumped through the lubrication inlet holes by the meshing action of a gear and a pinion wherein the meshing teeth of the gear and the pinion are aligned to interact with (i.e., pump lubrication through) the lubrication inlet holes. After the lubrication has removed heat from the frictional surfaces of the load brake assembly, the heated lubrication is pumped out of the load brake assembly through lubrication outlet holes located in a plate gear. The lubrication outlet holes are angled radially outwardly through the thickness of the plate gear from the inlet of the lubrication outlet holes to the outlet of the lubrication outlet holes. The outlets of the lubrication outlet holes travel at a higher rate of speed than the inlets of the lubrication outlet holes when the plate gear is driven (i.e., the outlets are located radially outward of the inlets, therefore the distance the outlets travel is greater than the distance the inlets travel in the same amount of time) thereby resulting in a pumping type action. The "stale" or hot lubrication returns to the oil sump of the gearbox where the heat is dissipated throughout the oil sump and the hot lubrication is regenerated to produce cool lubrication.

Gearboxes of hoist apparatuses typically employ multi-stage gear sets (e.g., a three-stage or a four-stage gear set). More particularly, gearboxes of hoist apparatuses that include a load brake assembly utilize multi-stage gear sets. Each stage of a gear set includes two gears and a shaft. The purpose of the gear set is to transfer the torque and speed input to the gearbox into an output torque and speed that generally includes a higher level of torque and a lower level of speed. The degree to which the input torque and speed are transferred depends on the gear ratio of the gear set. Hoist apparatuses commonly necessitate high gear ratio gear sets. Such high gear ratio gear sets are generally accomplished using multi-stage gear sets because of the difficulties associated with producing gear pairs that include non-similarly sized gears (e.g., a smaller pinion and a larger gear that mesh). The difficulties include the design of the tooth geometry at the meshing point.

Inclusion of a load brake assembly in the gearbox further complicates the design of a gearbox that is to include a two-stage gear set. It is generally desirous to include as large of a load brake assembly as possible. The large size of the load brake assembly complicates the spacing of the gear pairs which are typically difficult to design without added complications. Although the design of a two-stage gear set and load brake assembly is very complicated, the costs associated with developing multi-stage gear sets is not advantageous to the hoist apparatus producer nor to the hoist apparatus purchaser.

Accordingly, in another embodiment the invention provides a two-stage high gear ratio gear set for use in the gearbox of a hoist apparatus. The gear set may be used in conjunction with a load brake assembly such as the load brake assembly of the invention. The two-stage gear set of the invention includes a gear ratio substantially similar to a multi-stage gear set. The invention reduces the number of gears necessary, reduces the size of gearbox necessary, and thereby reduces the cost associated with acquiring a hoist apparatus.

Different categories of hoist apparatuses may be utilized for different lifting applications. The category of hoist apparatuses that is appropriate for a lifting application can be defined by evaluating the lifting requirements of the lifting application. In some cases, the category of hoist apparatuses that is selected is not appropriate for the lifting application. A hoist apparatus may not be appropriate for a particular lifting application if the hoist apparatus is designed to, for example, lift lighter loads, lift loads at a slower rate, and/or lift loads less frequently. A balancing between the cost of acquiring the hoist apparatus and the performance of the hoist apparatus is generally a consideration when evaluating hoist apparatus choices. However, if cost factors result in the selection of a hoist apparatus that is not appropriate for the particular lifting application, the hoist apparatus may experience premature failure. An inappropriate type of hoist may also be selected for a number of other reasons, including improper evaluation of the lifting requirements. Regardless of the reason for using a hoist apparatus that is not rated for a particular lifting application, the result is commonly the same (i.e., premature failure of the hoist apparatus and/or parts thereof).

The parts that make up the hoist apparatus are generally designed for use with a lifting application that falls into a particular window of lifting requirements. The hoist apparatus provider may provide warranties for the parts that ensure a particular reliability and life span for the parts. The warranties assume the hoist apparatus is utilized as intended. If the hoist apparatus is used in a lifting application that exceeds the window of lifting requirements, the hoist apparatus may experience premature failure. When the hoist apparatus fails, the hoist apparatus operator typically approaches the hoist apparatus provider, if the hoist apparatus is still under warranty, to repair the failed part. Hoist apparatus providers have no easy method of determining if a user has utilized a hoist apparatus improperly (i.e., determining whether or not the warranty is actually still in effect). Typically the hoist apparatus provider has to rely on the word of the hoist apparatus operator.

Accordingly, in another embodiment the invention provides a method and apparatus for recording operational lifting data. The operational lifting data is used to determine the duty cycle the hoist apparatus is actually used for. The actual duty cycle is compared with the duty cycle the hoist is designed for. If the actual duty cycle exceeds the designed duty cycle, an overload is recorded. The invention also records the lifting spectrum (i.e., the measure of load per a period of time), motor starts, and run times of the motor. From all of the data that is gathered the invention generates a useful remaining life of the hoist apparatus, or any parts thereof, prior to inspection, maintenance, overhaul and/or decommission. The useful remain life value is compared against the theoretical value of remaining useful life to determine if the hoist apparatus has been used in a lifting application commensurate with the window of lifting requirements the hoist apparatus was designed for. The number of overload conditions the hoist apparatus has experienced can also be reviewed. The hoist apparatus provider may void the warranty for the hoist apparatus if the hoist apparatus operator has utilized the hoist apparatus improperly. The operational data is also useful to the hoist apparatus operator in determining when to plan for inspection, maintenance, overhaul and/or decommission of the hoist apparatus.

Most hoist apparatuses typically utilize an alternating current (AC) variable frequency drive or power supply to provide power to the hoist motor. The hoist motor is generally controlled by using an inverter control. Control of the hoist motor operation controls rotation of the hoist drum (via the gearbox) which thereby controls the load. Load integrity and/or stabilization is important during hoist apparatus operation. Current inverter control technology requires supplemental control to ensure the inverter is stable under all circumstances. If the inverter is unstable the integrity and/or stabilization of the load may be comprised. Generally, hoist apparatuses include a load brake assembly and/or a feedback system from an encoder or a tachometer that are utilized to determine the stability of the inverter control. If the inverter control becomes unstable the load brake assembly is set to secure the load. The use of a load brake assembly and/or a feedback system adds significant cost to the overall hoist apparatus design and to maintenance of the hoist apparatus. Elimination of the need for the load brake assembly and/or the feedback system is advantageous for a hoist apparatus provider and a hoist apparatus purchaser.

Accordingly, in another embodiment the invention provides a control that verifies load integrity, and prevents possible load loss without the use of a load brake assembly and/or an encoder or similar feedback device. The control of the invention that verifies load integrity is disclosed in U.S. patent application Ser. No. 09/960,116, entitled "Material Handling System and Method of Operating the Same" filed on Sep. 21, 2001.

In still other embodiments, the invention provides combinations of the above.

Other features and advantages of the invention will become apparent to those skilled in the art upon review of the following detailed description, claims and drawings in which like numerals are used to designate like features.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
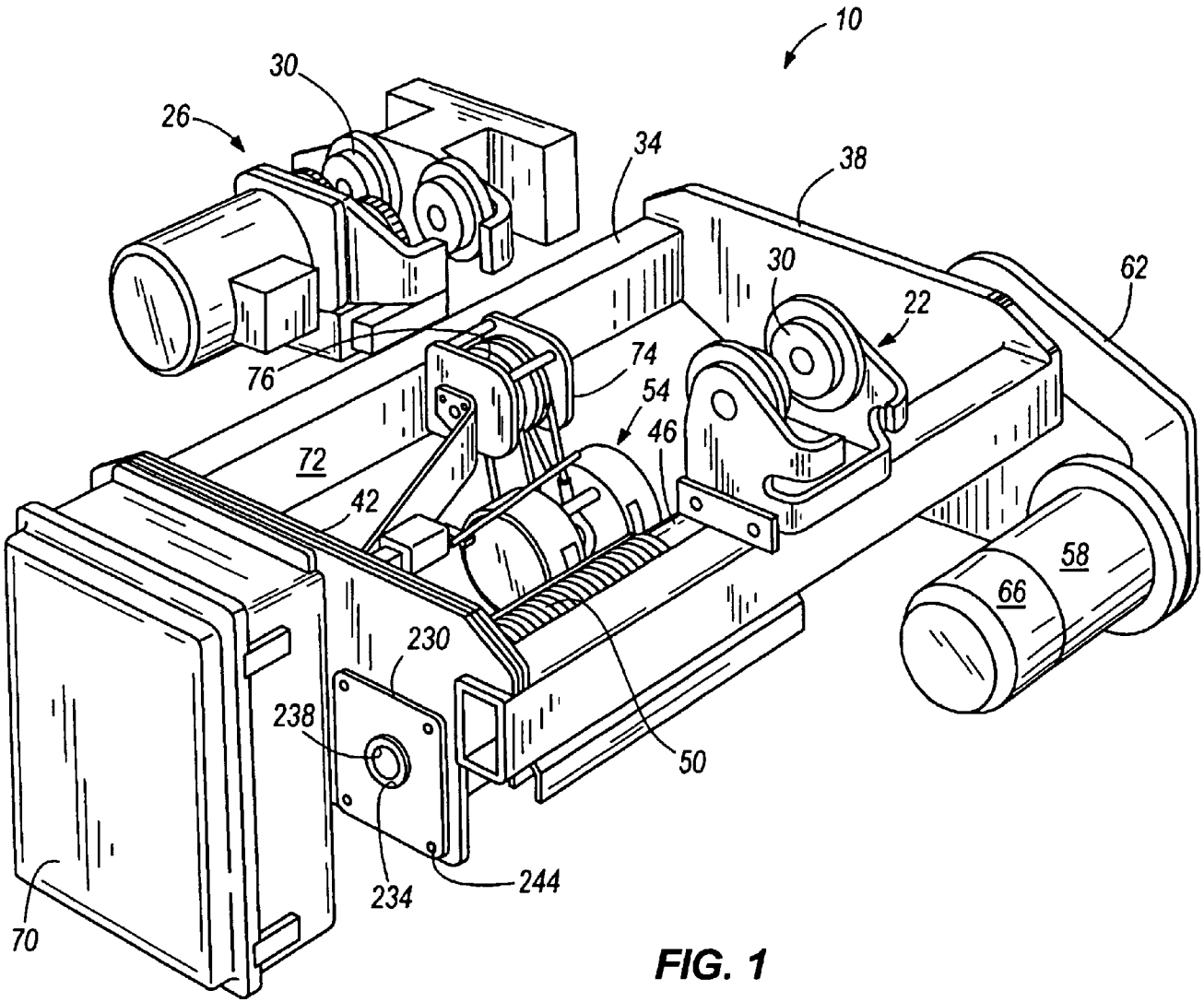
FIG. 1 illustrates a hoist apparatus embodying the invention.
Figure 2:
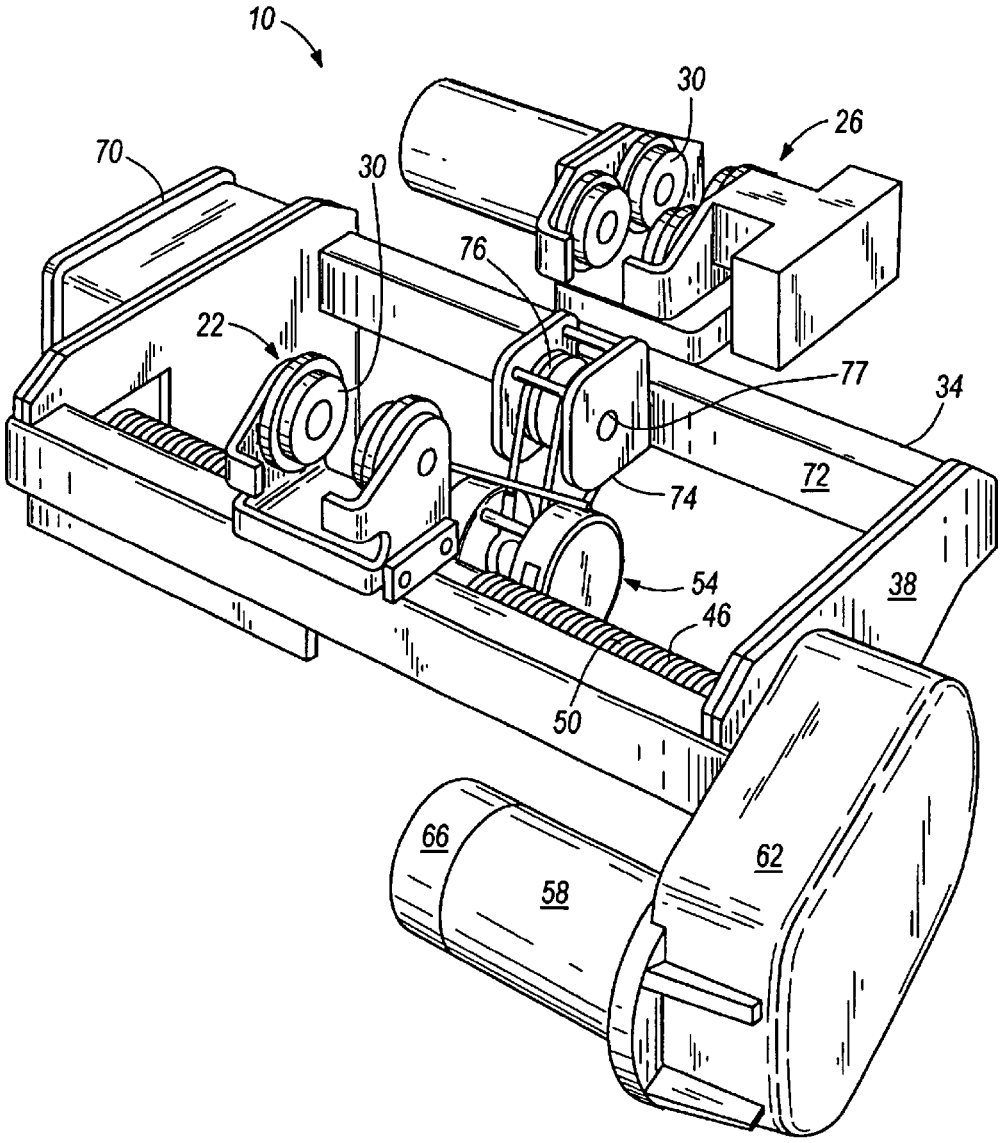
FIG. 2 illustrates a hoist apparatus embodying the invention.

Illustrated in FIGS. 1 and 2 is a hoist apparatus 10 embodying the invention. It should be understood that the present invention is capable of use in other hoist apparatuses and the hoist apparatus 10 is merely shown and described as an example of one such hoist apparatus. The illustrated hoist apparatus 10 is a monorail hoist apparatus.

Figure 8:
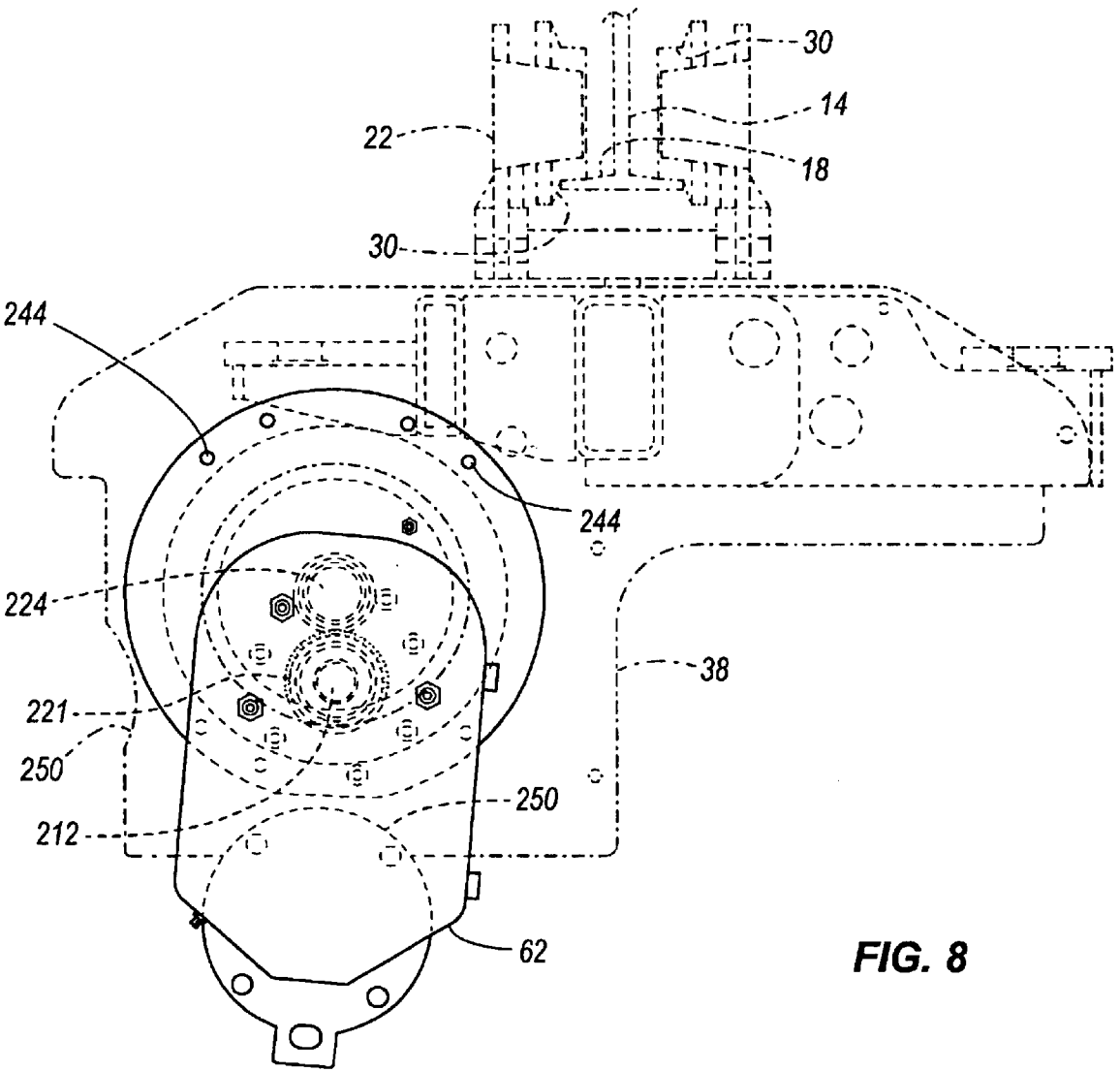
FIG. 8 illustrates a hybrid gearbox embodying the invention parallel mounted to the hoist apparatus illustrated in FIGS. 1 and 2.

The hoist apparatus 10 is suspended from a single support beam or rail 14 (see FIG. 8). The beam 14 is a standard I-beam having a bottom flange 18. The hoist apparatus 10 includes a pair of suspension trolleys 22 and 26 which include rollers 30 that run along the bottom flange 18 of the beam 14. The hoist apparatus 10 also includes a frame 34 which is supported by the suspension trolleys 22 and 26, and which includes a pair of side plates or members 38 and 42 which extend parallel with the beam 14.

The hoist apparatus 10 further includes a hoist drum 46 supported by the frame 34. The hoist drum 46 is generally transverse to the beam 14 and extends between the side members 38 and 42 of the frame 34. A hoist rope 50 is conventionally wound around the hoist drum 46 and a load engaging device 54 is coupled to the hoist rope 50 for vertical movement in response to rotation of the hoist drum 46 about a generally horizontal axis 55 (see FIG. 4). The load engaging device commonly includes a bottom block 56 through which the hoist rope 50 is reeved, and a hook 57 depending from the bottom block 56 (see FIG. 3). The hoist rope 50 is wound around the hoist drum 46 such that the hoist rope 50 winds on to and off of the hoist drum 46 in response to rotation of the hoist drum 46 in opposite wind-on and wind-off directions, respectively. The load engaging device 54 is located directly beneath the beam 14 for maximum load carrying capacity.

The hoist apparatus 10 also includes a hoist motor 58 for rotating the hoist drum 46. A gearbox 62 is coupled to the hoist motor 58 and to the hoist drum 46. The gearbox 62 includes a gear set that transfers the torque and speed of the output of the hoist motor 58 to a torque and speed utilized to drive the hoist drum 46. The hoist apparatus 10 further includes a brake device 66, preferably an electric brake coupled to the motor shaft 208 (see FIG. 7A) for stopping the rotation of the hoist drum 46. The hoist motor 58, the gearbox 62 and the brake device 66 are supported by the frame 34. The hoist apparatus 10 also includes a control cabinet 70 which is supported on the frame 34.

The hoist apparatus 10 thus far described is well known in the art and further description is therefore not needed.

Three-Part Bottom Block

With continued reference to FIGS. 1 and 2, the frame 34 includes a support member 72 which is perpendicular to the beam 14 and which extends between the side members 38 and 42. A running sheave nest 74 is mounted on the support member 72 for use in supporting the load engaging device 54. In one embodiment the running sheave nest 74 includes two running sheaves 76 that rotate about a cross shaft 77. A hoist apparatus that utilizes a three-part bottom block typically includes a running sheave nest similar to running sheave nest 74. The running sheave nest 74 of the hoist apparatus 10 is located directly beneath the beam 14 for optimum support of the load engaging device 54.

Typically, a three-part bottom block includes an integral equalizer sheave nest that extends from the top of the three-part bottom block causing the three-part bottom block to be quite large. A three-part bottom block is typically reeved using the integral equalizer sheave nest to provide equalization of the hoist rope. If the hoist rope is not equalized, the hoist rope may experience unevenly distributed forces that may result in loss of load stability and/or integrity.

Figure 3:
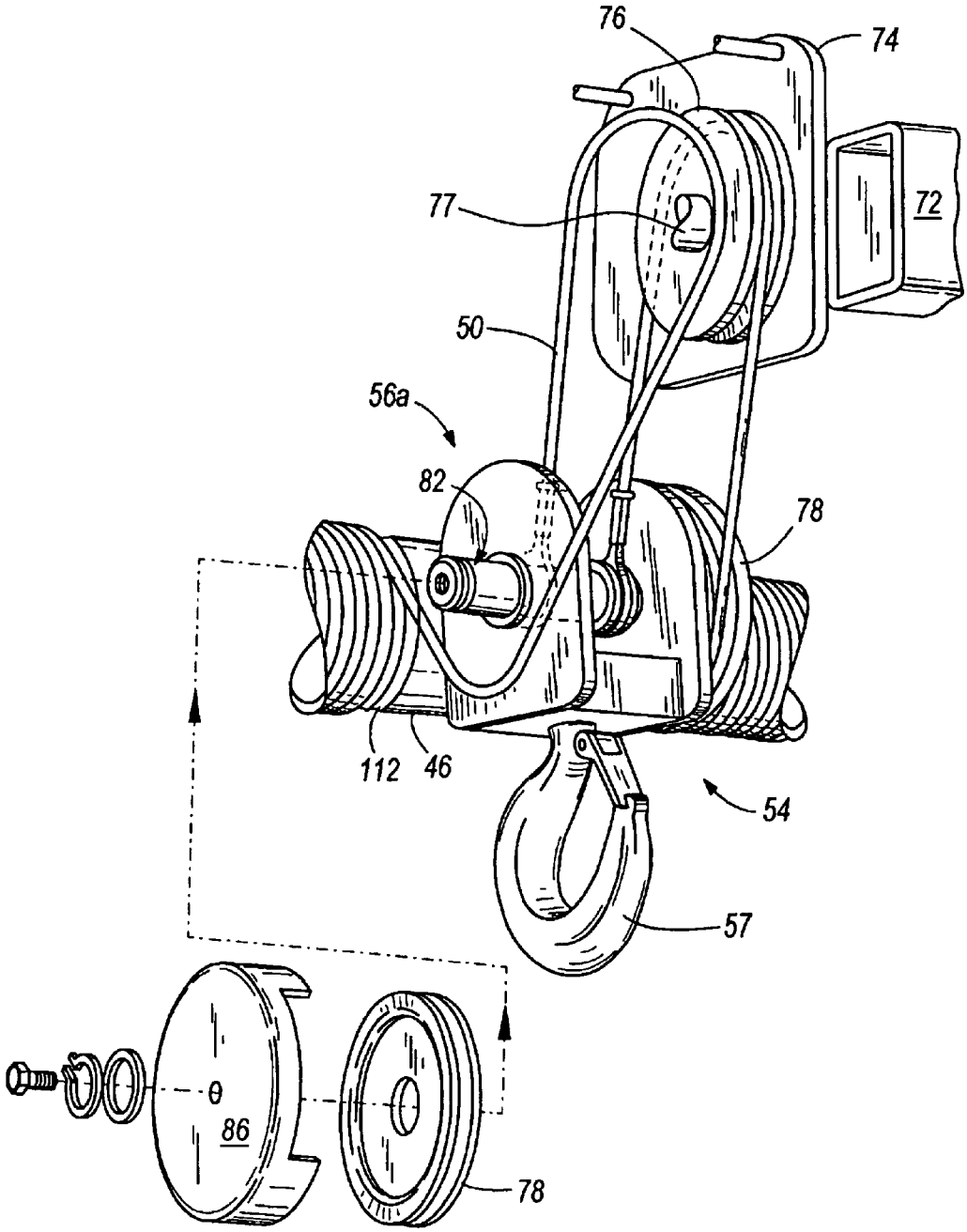
FIG. 3 illustrates a three-part double reeved bottom block embodying the invention.
Figure 4:
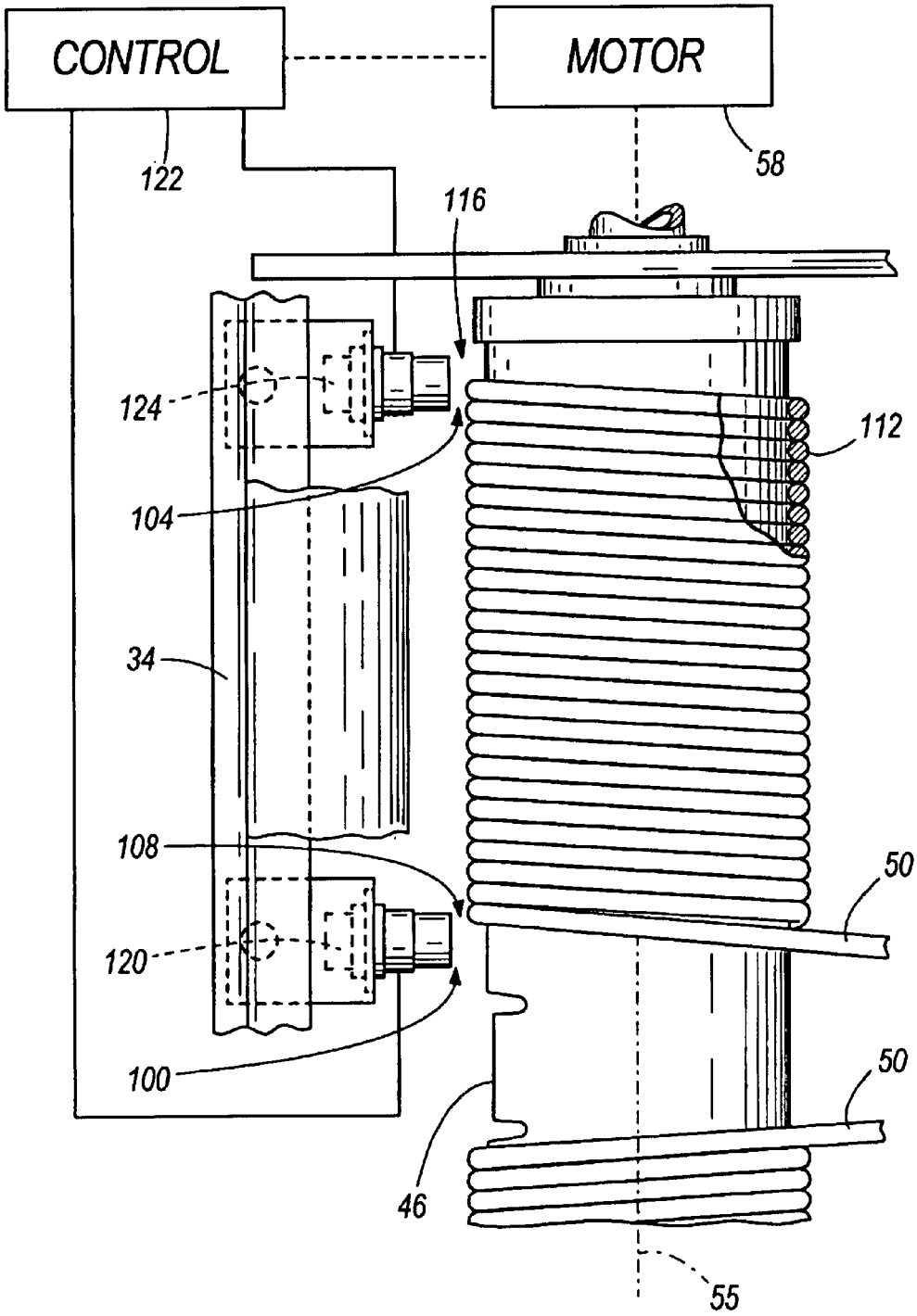
FIG. 4 illustrates a partial view of the hoist apparatus illustrated in FIGS. 1 and 2 including a proximity limit switch embodying the invention.

The three-part bottom block 56 of the invention eliminates the need for an equalizer sheave nest to provide equalization of the hoist rope, thereby eliminating the need for the integral equalizer sheave nest typically used on top of a three-part bottom block. Therefore, the three-part bottom block 56 allows for reduced dead space through which a load cannot be lifted. In one embodiment, the bottom block 56 of the load engaging device 54 is a three-part double reeved bottom block 56*a* and the hoist rope 50 employs a three-part double true vertical lift reeving as illustrated in FIG. 3. The three-part bottom block 56 may include two running sheaves 78 and a cross shaft 82. Each running sheave 78 is partially enclosed during operation by a cover 86.

The three-part bottom block 56 of the invention preferably has a height profile which is generally equal to the height profile of a similarly configured two part double block (i.e., the running sheaves 78 of the three-part bottom block 56 and the running sheaves of the two part bottom block are similarly sized). The overall height profile of a bottom block is typically dictated primarily by the size of the running sheaves used in that bottom block.

The hoist rope equalization function commonly performed by the integral equalizer sheave nest that is typically used on top of a three-part bottom block is handled in the invention by selective placement of the hoist rope 50 on the hoist drum 46. Hoist rope clips 79 (see FIG. 6) are utilized to provide selective placement of the hoist rope 50 on the hoist drum 46. In one embodiment the hoist rope 50 includes two separate hoist ropes 50. For illustrative purposes, selective placement of the hoist rope 50 on the hoist drum 46 is described herein with respect to the embodiment that includes two separate hoist ropes 50. It should be understood that the present invention is capable of use with other three-part bottom blocks and reeving configurations and that the three-part double reeved bottom block 56*a* and the three-part double true vertical lift reeving are merely shown and described as an example of one such three-part bottom block and reeving configuration.

Figure 6:
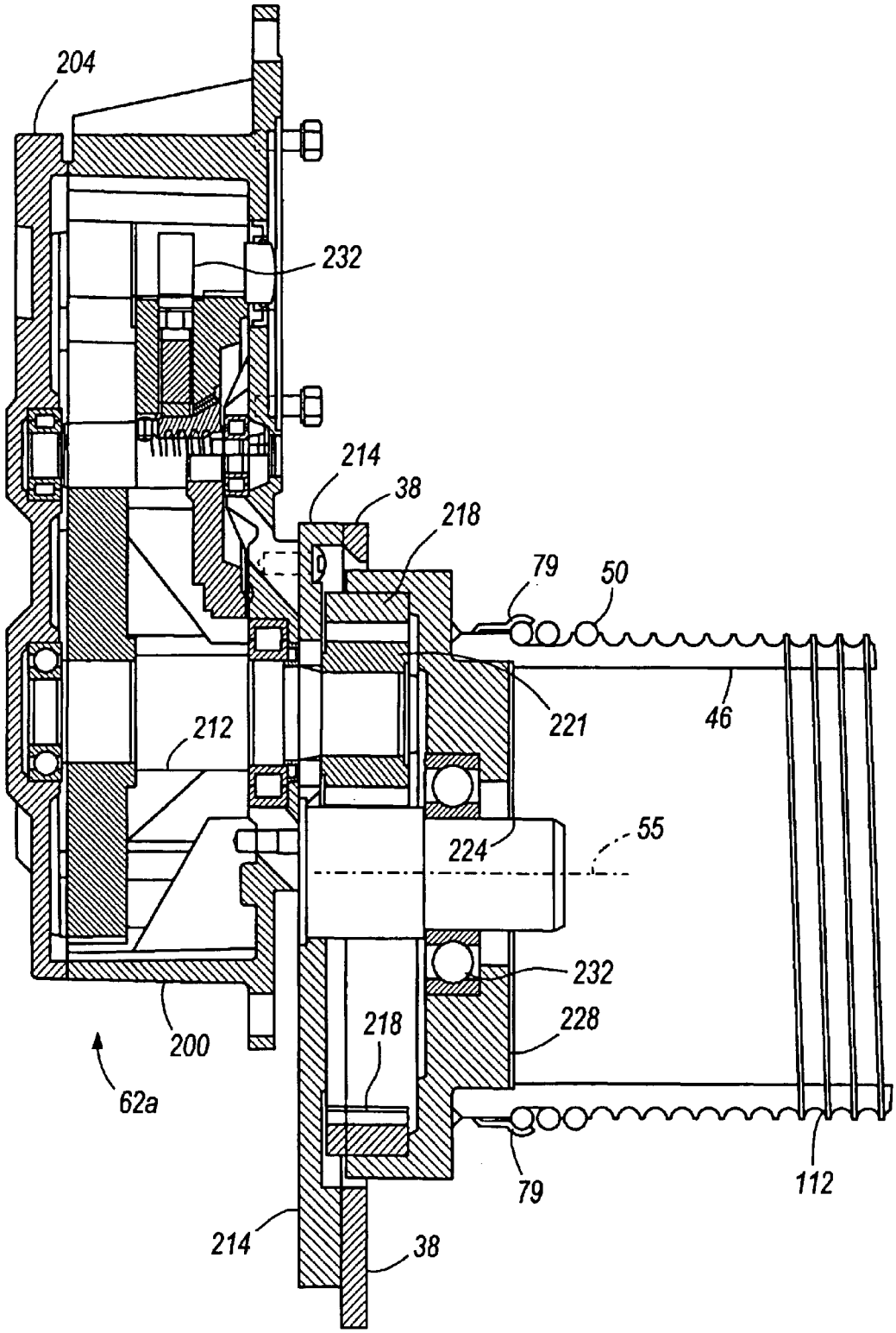
FIG. 6 illustrates a sectional view of a hybrid gearbox including a two-stage high gear ratio gear set in combination with the adapter plate and the ring gear embodying the invention mounted to the hoist apparatus illustrated in FIGS. 1 and 2.

When reeving the hoist apparatus 10, a first end of each hoist rope 50 is dead-ended on the cross shaft 82. The hoist rope 50 may be dead-ended using a number of techniques including swaging the hoist rope 50 on to itself as illustrated, swaging the hoist rope 50 to a member coupled to the cross shaft 82, and the like. A second end of each hoist rope 50 is selectively placed on the hoist drum 46. As illustrated in FIG. 6, the second end of the hoist rope 50 is removably coupled to the hoist drum 46 using at least one hoist rope clip 79. In one embodiment the hoist rope clip 79 may removably couple a substantial portion of at least one winding of the hoist rope 50 on the hoist drum 46 (i.e., the hoist rope clip 79 clips down over a substantial portion, or all, of the circumference of the hoist drum 46). In other embodiments smaller or larger hoist rope clips 79 may be utilized. Additionally, a plurality of hoist rope clips 79 may be utilized. Preferably each hoist rope clip 79 couples the hoist rope 50 to the hoist drum 46 such that when the hoist rope clip 79 is locked the hoist rope 50 is not allowed to move. When the hoist rope clip 79 in unlocked, the hoist rope 50 can be selectively placed on the hoist drum 46.

The middle part of each hoist rope 50 is reeved from the hoist drum 46, down and around the running sheave 78 (part one), back up to the running sheave nest 74 and around a running sheave 76 (part two), and back down to the dead-end on the cross shaft of the bottom block 56. After each hoist rope 50 is similarly reeved, the bottom block 56 is supported by the hoist rope 50. If each hoist rope 50 was exactly the same length and the hoist rope 50 was coupled to the hoist drum 46 in the same respective spot on each side of the hoist drum 46, the hoist rope 50 would be equalized (i.e., assuming the remaining parts of the hoist apparatus 10 were sized exactly the same as corresponding parts, e.g., each side of the hoist drum 46 was exactly identical). The reality of hoist rope 50 and hoist apparatus 10 construction demonstrates that after reeving is completed each part (e.g., part one, part two, and part three) of the hoist rope 50 is not exactly the same length as the corresponding part on the other hoist rope 50. An equalizer sheave nest is typically utilized to correct for this variance. The equalizer sheaves of the equalizer sheave nest increment in response to forces applied by the hoist rope 50 to provide equalization of the hoist rope 50.

The invention allows the individual reeving the hoist rope 50 to equalize the hoist ropes 50 by adjusting the length of each hoist rope 50 that comes off the hoist drum 46 to support the bottom block 56. The first end of the hoist rope 50 can be pulled closer to the end of the hoist drum or moved further away form the end of the hoist drum (i.e., selectively placed) to provide hoist ropes 50 that appear to be exactly the same length (i.e., equalized hoist ropes). In one embodiment, the individual reeving the hoist rope 50 knows the hoist rope 50 is equalized when the cross shaft of the bottom block is horizontal. Generally, once the hoist rope 50 is equalized the hoist rope 50 remains equalized throughout the useful life of the hoist rope 50. If at any time the hoist rope 50 becomes unequalized, an individual may unlock at least one hoist rope clip 79 and reselectively place the hoist rope 50 to reequalize the hoist rope 50.

The three-part bottom block 56 and the reeving configuration utilized in the invention provide a lifting capacity that is substantially similar to a lifting capacity of a similarly configured three-part bottom block that includes an integral equalizer sheave nest (i.e., the only difference between the hoist apparatuses with substantially similar lifting capacities is that one hoist apparatus utilizes a three-part bottom block with an integral equalizer sheave nest and the other hoist apparatus utilizes the three-part bottom block of the invention; the two bottom blocks are similar but for the inclusion of the equalizer sheave nest on the one bottom block, e.g., the running sheaves of the two bottom blocks are similarly sized).

Proximity Limit Switch

The hoist rope 50 has a maximum wind-on point 100 (a point on the hoist rope 50) beyond which it is not desirable to wind the hoist rope 50 on to the hoist drum 46. This is the point at which the bottom block 56 or a load (not shown) suspended by the by the hook 57 comes too close to the frame 34 or the hoist drum 46. The hoist rope 50 also has a maximum wind-off point 104 (a point on the hoist rope 50) beyond which it is not desirable to wind the hoist rope 50 off of the hoist drum 46. This is the point at which a load suspended by the hook 57 comes too close to the ground or the floor, or at which it is not desirable for the hoist rope 50 to pay out further. The maximum wind-on point 100 of the rope is at a certain first point 108 on the hoist drum 46 (or a certain distance from the center of the hoist drum 46), in the groove 112, when the rope is properly wound on to the hoist drum 46. The maximum wind-off point 104 of the hoist rope 50 is at a certain second point 116 on the hoist drum 46 (or a certain distance from the center of the hoist drum 46), in the groove 112, when the hoist rope 50 is properly wound on to the hoist drum 46.

The hoist apparatus 10 also comprises a first or upper limit proximity limit switch 120 mounted on the frame 34 adjacent the first point 108 on the hoist drum 46, such that the hoist drum 46 moves relative to the first proximity limit switch 120. The first proximity limit switch 120 is a known type of switch that is capable of sensing the presence of the hoist rope 50 without touching the hoist rope 50. A suitable switch is manufactured by Siemens Energy and Automation, Inc., and is sold as Model No. 3RG40 24-0KA00. The first proximity limit switch 120 is mounted on the frame 14 by a mounting bracket (not shown). Any suitable bracket can be employed.

The first proximity limit switch 120 is normally closed (i.e., closed when it does not sense anything in its proximity) and is opened when it senses the presence of the hoist rope 50 at the first point 108 on the hoist drum 46 (i.e., opened when it senses the hoist rope 50 at the maximum wind-on point 100 on the hoist rope 50). Opening of the first proximity limit switch 120 upon sensing the hoist rope 50 signals a control 122 to prevent the hoist motor 58 from further rotating the hoist drum 46 in the wind-on direction, thereby preventing further lifting of the load.

The hoist apparatus 10 also comprises a second or lower limit proximity limit switch 124 mounted on the frame 34 adjacent the second point 116 on the hoist drum 46, such that the hoist drum 46 moves relative to the second proximity limit switch 124. The second proximity limit switch 124 is preferably identical to the first proximity limit switch 120, except as explained below, and is mounted on the frame 34 by a mounting bracket that is substantially identical to the bracket used to mount the first proximity limit switch 120. The second proximity limit switch 124 is normally open (i.e., open when it does not sense anything in its proximity) and is closed when it senses the presence of the hoist rope 50 at the second point 116 on the hoist drum 46 (i.e., closed when it senses the hoist rope 50 at the maximum wind-off point 104 on the hoist rope 50, e.g., when the hoist rope 50 has not wound off the hoist drum 46 beyond the maximum wind-off point 104). When the hoist rope 50 winds off the hoist drum 46 beyond the maximum wind-off point 104, so that the second proximity limit switch 124 does not sense the presence of the hoist rope 50 at the second point 116 on the hoist drum 46, or senses the absence of the maximum wind-off point 104 on the hoist rope 50, the second proximity limit switch 124 opens. Opening of the second proximity limit switch 124 signals the control 122 to prevent the hoist motor 58 from further rotating the hoist drum 46 in the wind-off direction, thereby preventing further lowering of the load. The preferred normally-open switch is manufactured by Siemens Energy and Automation, Inc., and is sold as Model No. 3RG40 24-0KB00.

Hybrid Gearbox

Figure 5:
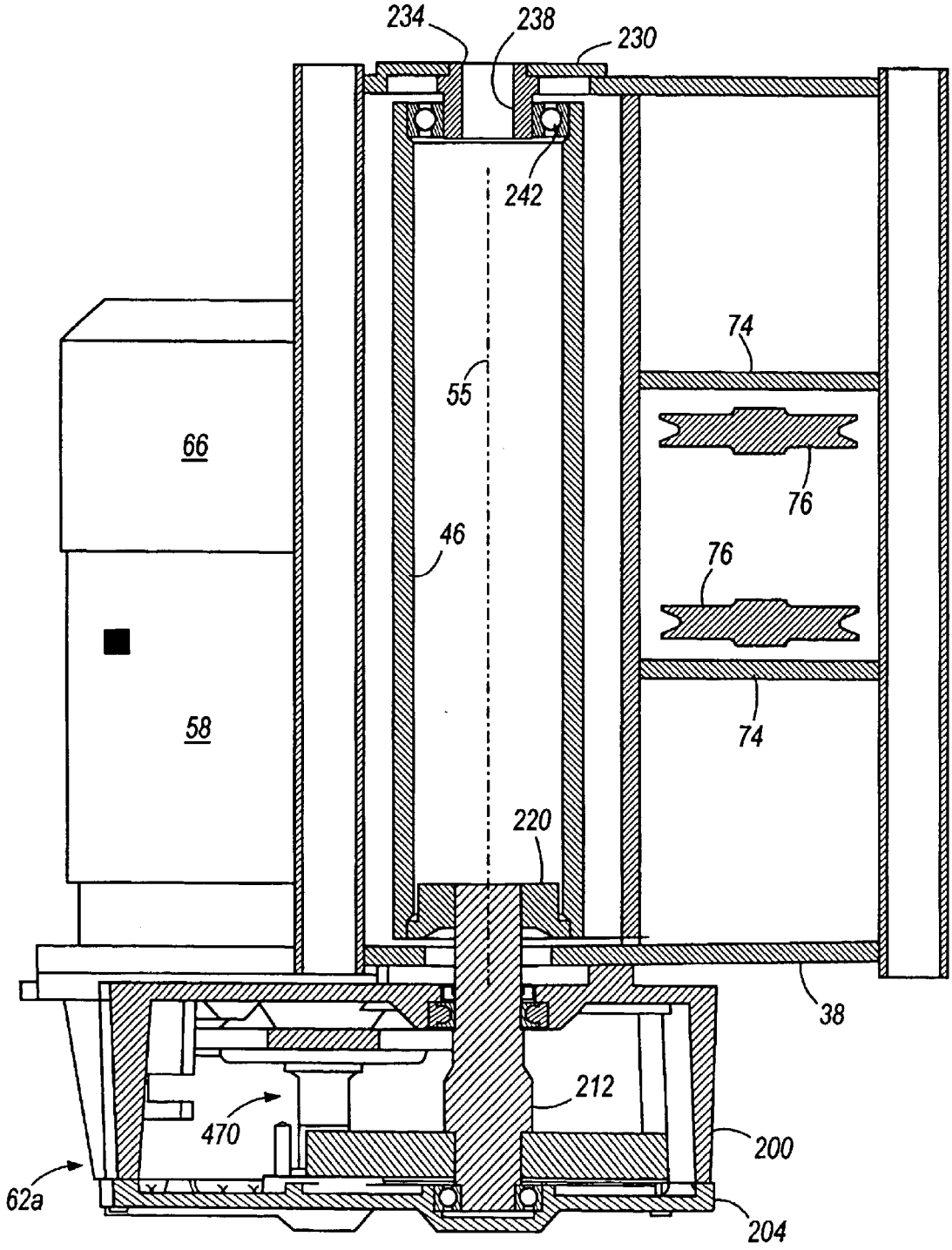
FIG. 5 illustrates a hybrid gearbox embodying the invention conventionally mounted to the hoist apparatus illustrated in FIGS. 1 and 2.
Figure 7A:
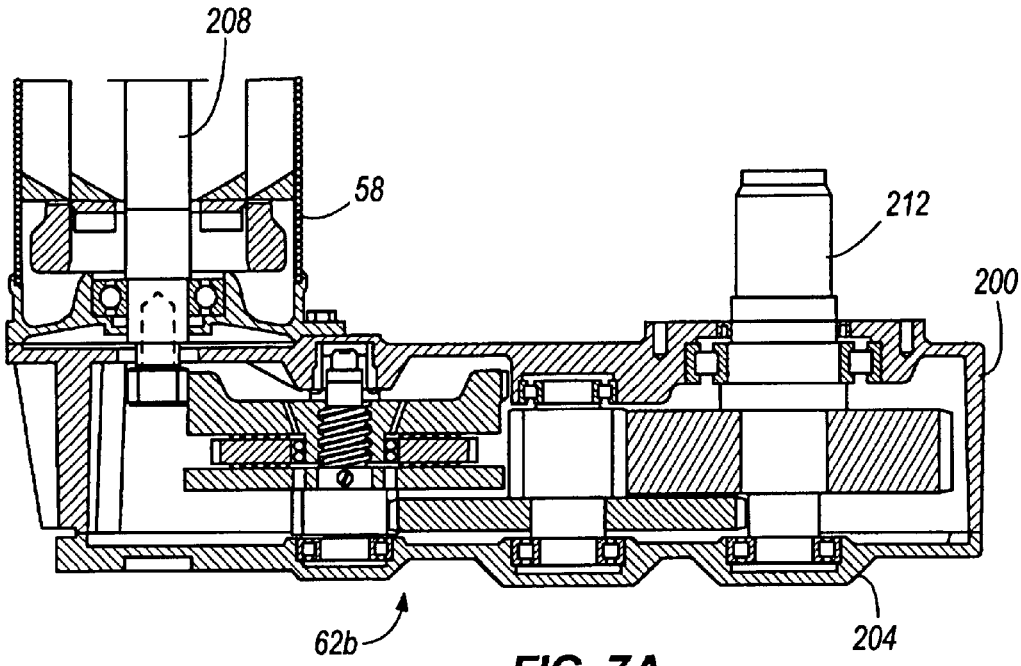
FIG. 7A illustrates a section view of a hybrid gearbox embodying the invention.
Figure 7B:
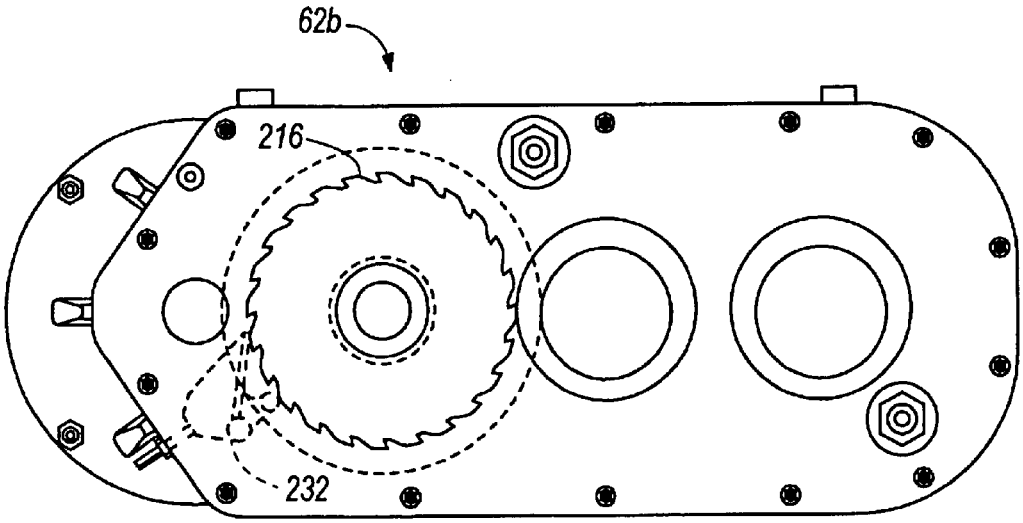
FIG. 7B illustrates a partial front view of the hybrid gearbox illustrated in FIG. 7A.

As illustrated in FIGS. 5, 6, 7A and 7B, the gearbox 62 includes a gear case 200 and a cover 204. FIGS. 5 and 6 illustrate a first gearbox 62*a*, and FIGS. 7A and 7B illustrates a second gearbox 62*b*. The second gearbox 62*b* is designed for a range of lifting applications that incorporate higher lifting requirements than the lifting requirements incorporated in the range of lifting applications the first gearbox 62*a* is designed for. Each gearbox 62*a* and 62*b* can be used in accordance with the invention. It should be understood that the present invention is capable of use with other gearboxes and that the gearboxes 62*a* and 62*b* are merely shown and described as examples of such gearboxes.

The gearbox 62 couples the hoist motor 58 to the hoist drum 46. The gearbox 62 includes a gear set, such as the two-stage high gear ratio gear set 470 described below, that transfers the torque and speed output by an output shaft 208 of the hoist motor 58 to a torque and speed that is utilized to drive the hoist drum 46. The gear set may be used in conjunction with a load brake assembly, such as the load brake assembly 400 discussed below. An output shaft 212 of the gearbox 62 is coupled to the hoist drum 46 to selectively rotate the hoist drum at the output torque and speed of the gearbox 62 in opposite wind-on and wind-off directions.

In one embodiment the gearbox 62 is mounted to the hoist drum 46 in a conventional manner. An example of a gearbox 62 mounted to the hoist drum 46 in a conventional manner is illustrated in FIG. 5. Generally, a gearbox 62 is mounted to the hoist drum 46 in a conventional manner when the hoist apparatus 10 the gearbox 62 is associated with incorporates lifting requirements in the lower part of the range of lifting applications the gearbox 62 is designed to be used for.

Figure 9:
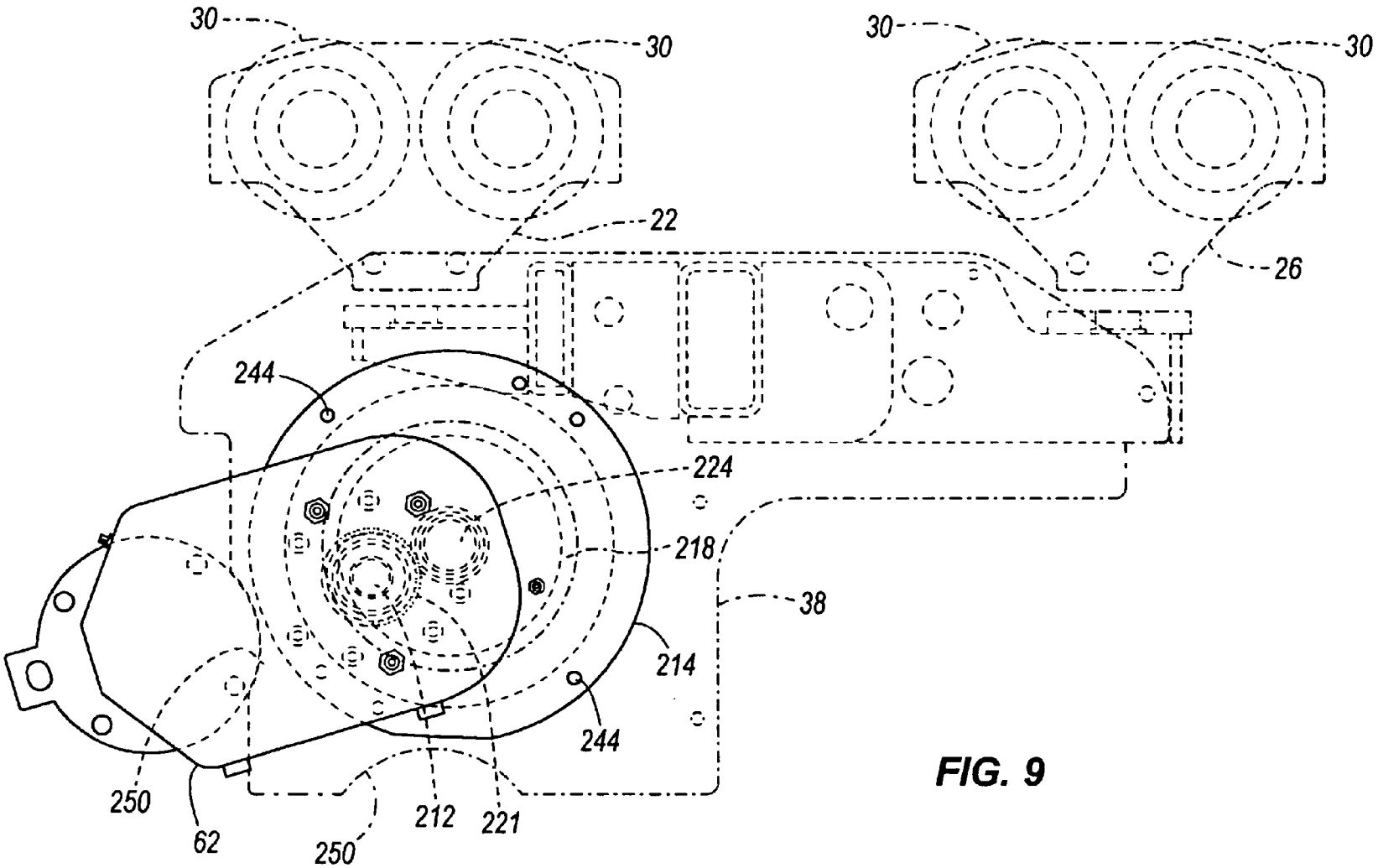
FIG. 9 illustrates a hybrid gearbox embodying the invention cross mounted to the hoist apparatus illustrated in FIGS. 1 and 2.

In another embodiment, the gearbox 62 is mounted to the hoist drum 46 using an adapter plate 214 and an external ring gear 218. The adapter plate 214 and the external ring gear 218 allow the hoist apparatus provider to quickly and efficiently transform the output torque and speed of the gearbox 62 to a second output torque and speed of the gearbox 62. The hoist apparatus provider is able to provide a second category and/or type of hoist apparatus without providing a second gearbox and/or frame. An example of a gearbox 62 mounted to the hoist drum 46 using the adapter plate 214 and the external ring gear 218 is illustrated in FIGS. 6, 8 and 9. Generally, a gearbox 62 is mounted to the hoist drum 46 using the adapter plate 214 and the external ring gear when the hoist apparatus 10 the gearbox 62 is associated with incorporates lifting requirements in the upper part of the range of lifting applications the gearbox 62 is designed to be used for.

When the gearbox 62 is conventionally mounted to the hoist drum 46, the output shaft 212 of the gearbox 62 is coaxial with the axis 55. The output shaft 212 acts as a spline which is directly coupled to a drive member 220 which is fixedly mounted to the hoist drum 46. The drive member 220, and thereby the hoist drum 46, rotate directly in response to the rotation of the output shaft 212. The output shaft 212 additionally supports the end of the hoist drum 46 adjacent to the side member 38. The direct coupling between the output shaft 212 and the drive member 220 provides rotational support to the hoist drum 46.

When the gearbox 62 is mounted using the adapter plate 214 and the external ring gear 218, the output shaft 212 of the gearbox 62 is no longer coaxial with the axis 55. A pinion 221 coupled to the end of the output shaft 212 meshes with the external ring gear 218 to rotate the hoist drum 46. In one embodiment the gear teeth of the external ring gear 218 are radially inward of the body of the external ring gear 218. The external ring gear 218 may be sized to provide the desired output torque and speed from the gearbox. The external ring gear 218 is considered to be part of the gear set of the gearbox 62. Utilization of the external ring gear 218 therefore alters the overall gear ratio of the gear set. Differently sized external ring gear may be utilized in accordance with the invention to provide the desired output torque and speed to drive the hoist drum 46. In other embodiments, any number of other types of gears may be utilized external to the gearbox 62 to provide the desired output torque and speed to drive the hoist drum 46.

The external ring gear 218 is coupled to a support member 228. The support member 228 is fixedly mounted to the hoist drum 46. The support member 228, and thereby the hoist drum 46, rotate in response to the rotation of the external ring gear 218 caused by the meshing action of the external ring gear 218 with the pinion 221 coupled to the output shaft 212. A pin 224 which is coupled to the adapter plate 214 is utilized to support the end of the hoist drum 46 adjacent the side member 38. The pin 224 is coupled to the support member 228 that is coupled to the hoist drum 46. A bearing assembly 232 may also be used to support the pin 224.

As illustrated in FIG. 1, the hoist apparatus 10 includes a hoist drum cover plate 230. The frame 34 is configured to mount the gearbox 62, hoist motor 58, and brake device 66 combination on either side member 38 and 42. The illustrated embodiment of the hoist apparatus 10 includes the gearbox 62, hoist motor 58, and brake device 66 combination mounted on the side member 38. The hoist drum cover plate 230 is therefore mounted to the side member 42. The hoist drum cover plate 230 includes an aperture 234. The aperture 234 is utilized to support a pin 238 that supports the end of the hoist drum 46 adjacent the side member 42. The pin 238 allows the hoist drum 46 to rotate. As illustrated in FIG. 5, the pin 238 is further supported by a bearing assembly 242.

The mounting holes 244 (illustrates the location) in the frame 34 that are used to mount the hoist drum cover plate 230 may also be used to mount the adapter plate 214. Each of the side members 38 and 42 include similar mounting holes 244. As illustrated in FIG. 6, to mount the gearbox 62 using the adapter plate 214 and the external ring gear 218, support member 228 including the external ring gear 218 is first fixedly mounted to the hoist drum 46. The adapter plate 214 including the pin 224 is mounted to the gearbox 62 and the assembly of the adapter plate 214 and the gearbox 62 is then mounted to the frame 34 using the mounting holes 244 for the hoist drum cover plate 230. As illustrated in FIGS. 8 and 9, in one embodiment the adapter plate 214 is circular. The adapter plate 214 may be non-circular in shape (e.g., square, rectangular, and the like). The assembly of the gearbox 62 and the adapter plate 214 can be mounted to the frame 34 in a number of configurations by rotating the assembly of the gearbox 62 and the adapter plate 214 with respect to the mounting holes 244. Alternatively, the adapter plate 214 may include a plurality of sets of fastener holes spaced similar to the mounting holes 244 thereby allowing mounting of the assembly in a large number of configurations.

Dependent upon the lifting application and the type of hoist apparatus utilized, the assembly of the gearbox 62 and the adapter plate 214 may be mounted more advantageously in a first position than in a second position. For example, the combination of the gearbox 62, the hoist motor 58 and the braking device 66 may be rotated out of the path of the load engaging device 54 and/or the load to provide additional headroom to the hoist apparatus 10. Additionally, the combination of the gearbox 62, the hoist motor 58 and the braking device 66 may be mounted in a particular fashion to provide balancing of the overall hoist apparatus 10 with respect to the beam 14. Commonly counterweights are utilized to provide balancing of the hoist apparatus 10. Use of counterweights increases the costs associated with acquiring a hoist apparatus 10 and it is therefore advantageous to provide self-balancing of the hoist apparatus 10 by mounting the combination of the gearbox 62, the hoist motor 58 and the braking device 66 in a particular orientation. FIG. 8 illustrates a parallel mounted configuration and FIG. 9 illustrates a cross mounted configuration. As discussed above, a number of other mounting configurations may be utilized. The side members 38 and 42 of the frame 34 may include cutouts 250 that correspond to the shape of the hoist motor 58 to allow for mounting in certain configurations. FIGS. 8 and 9 illustrate gearbox 62*a*. If gearbox 62*b* was utilized, the larger size of the gearbox 62*b* would result in the hoist motor 58 extending beyond the frame 34 at every angle, thereby providing clearance to mount the assembly of the gearbox 62 and the adapter plate 214 in any desired configuration.

Self-Lubricating Load Brake Assembly

Figure 10:
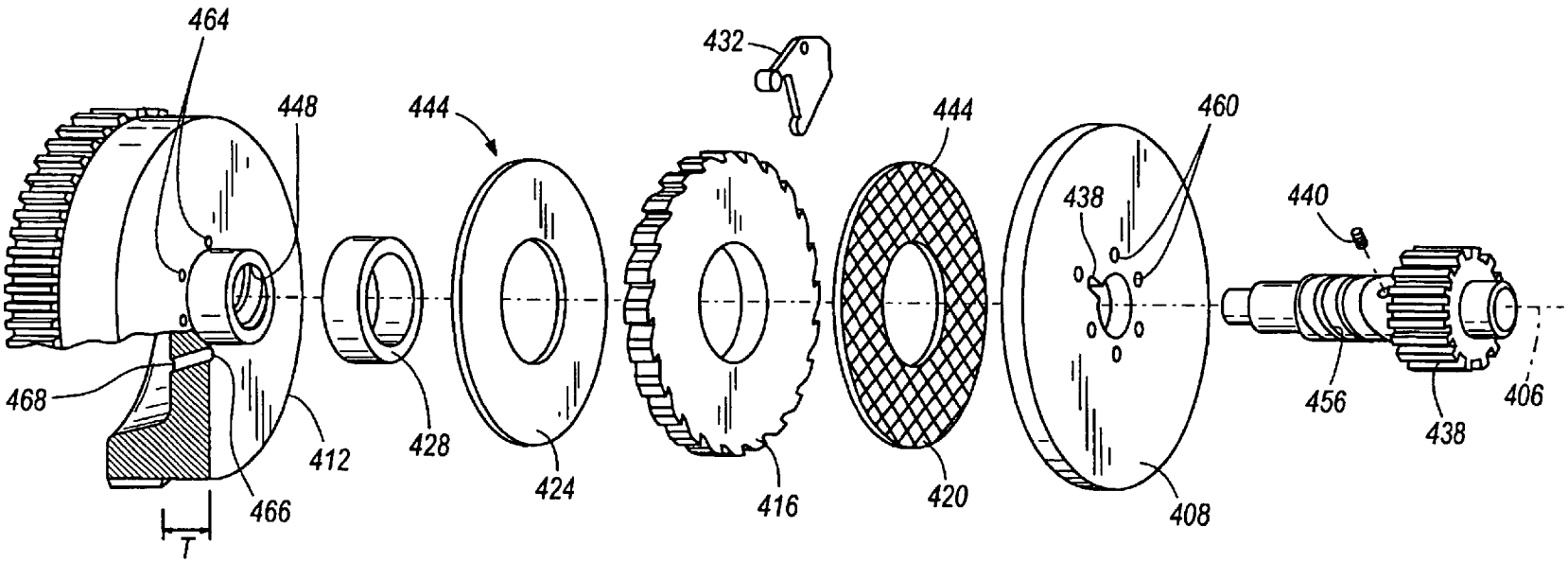
FIG. 10 illustrates an exploded view of a load brake assembly embodying the invention.
Figure 11:
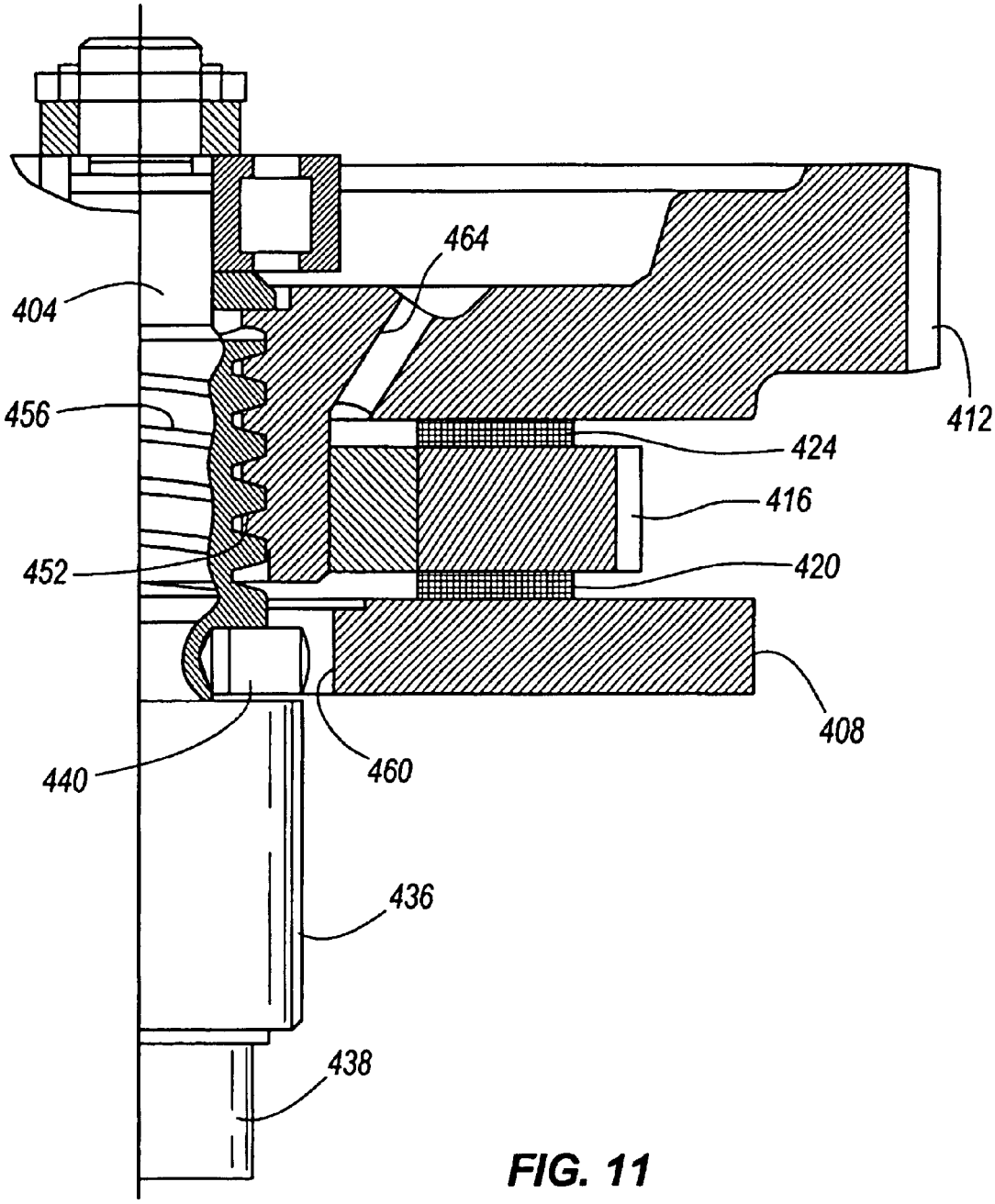
FIG. 11 illustrates a partial sectional view of a load brake assembly embodying the invention.
Figure 12:
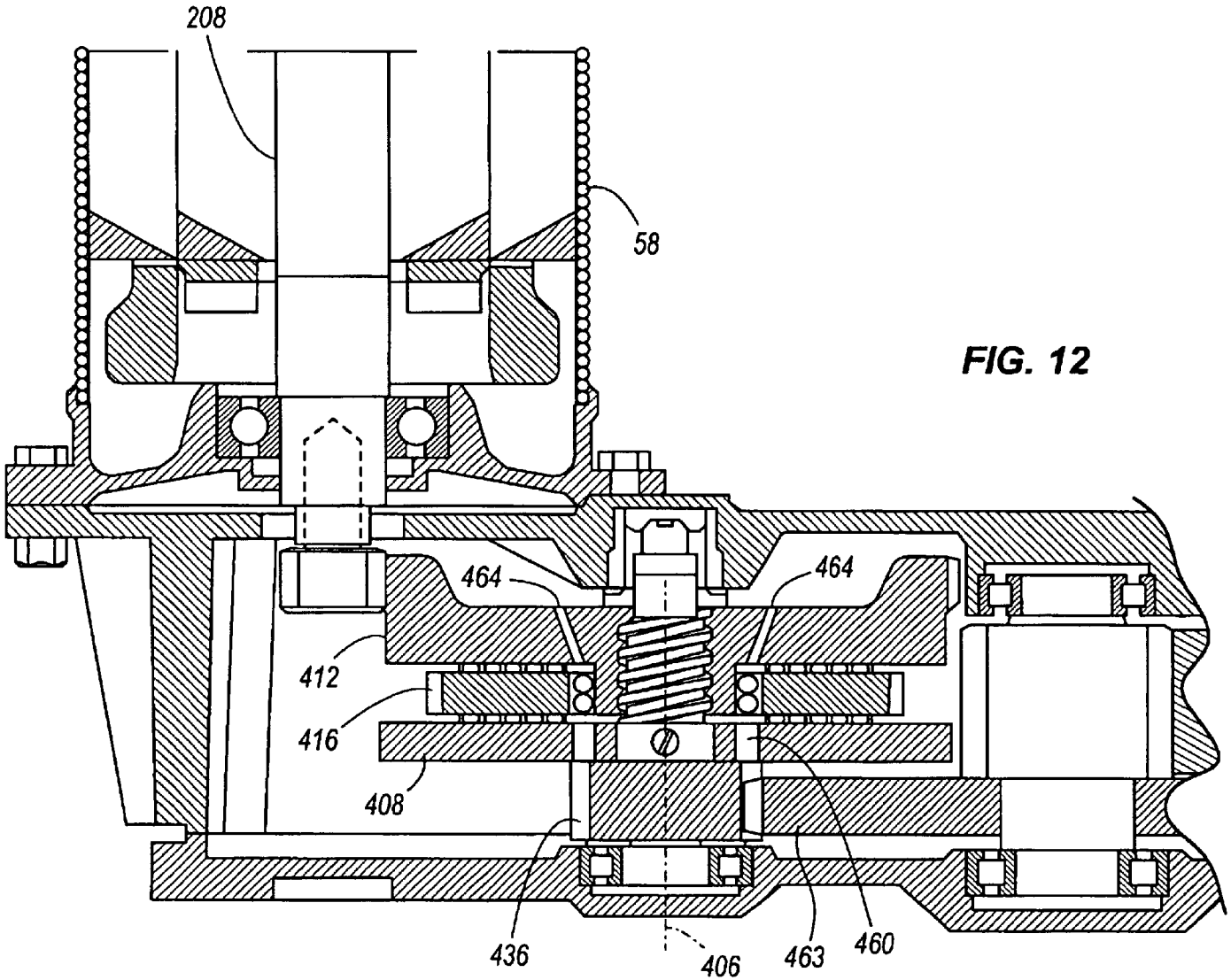
FIG. 12 illustrates a partial sectional view of a gearbox including the load brake assembly embodying the invention.
Figure 13:
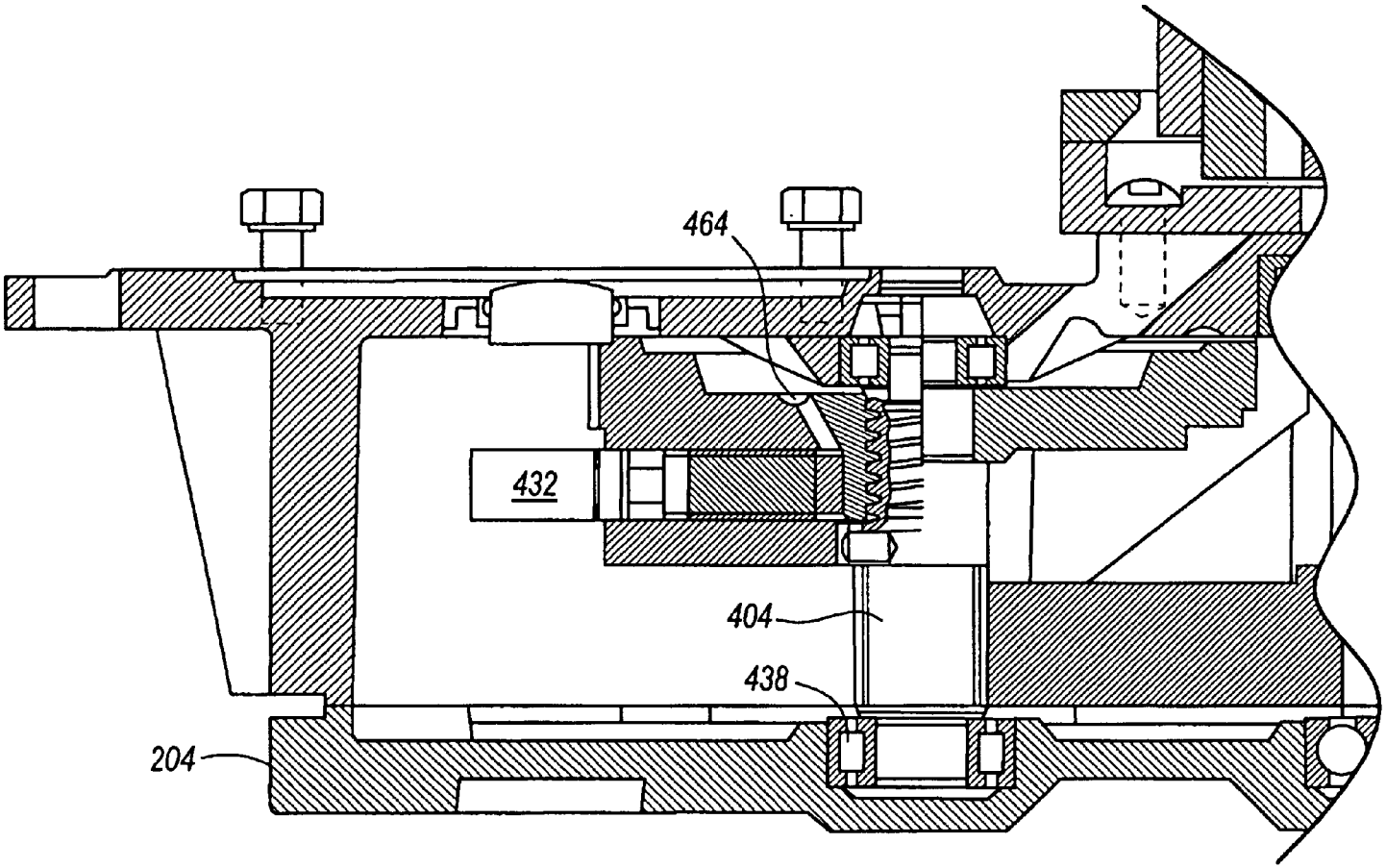
FIG. 13 illustrates a partial sectional view of a gearbox including the load brake assembly embodying the invention.

An exploded view of a load brake assembly 400 is illustrated in FIG. 10. FIGS. 11, 12 and 13 are sectional views that further illustrate the load brake assembly 400. It should be understood that the present invention is capable of use in other load brake assemblies and the load brake assembly 400 is merely shown and described as an example of one such load brake assembly. The illustrated load brake assembly 400 is of the type commonly referred to as a Weston style load brake. Weston style load brakes are generally considered to be the industry standard for load brake assemblies.

Some components of the illustrated load brake assembly 400 may commonly be considered to be part of the gear set of the gearbox 62. The load brake assembly 400 includes a load shaft 404 that is commonly supported by the gearbox 62 for rotation about a generally horizontal axis 406, a pressure plate 408 fixedly mounted onto the load shaft 404, a plate gear 412 arranged on the load shaft 404 for limited movement in an axial direction, a ratchet disc 416, a first friction pad 420, a second friction pad 424, a bushing 428, a pawl 432, and a pinion 436.

In one embodiment the pressure plate 408 is press fit on to the load shaft 404. The pinion 436 is integral to the load shaft 404. A bearing 438 rotatably supports one end of the load shaft 404. In one embodiment the bearing 438 is held in place by a retainer to allow removal of the cover 204 for inspection of the gear set and load brake assembly 400 after lubrication has been drained from the gearbox 200.

The pressure plate 408 includes a keyhole 438 that accepts a pin 440. The pin 440 fixedly mounts the pressure plate 408 to the load shaft 404 so that the rotation of the pressure plate 408 is directly dependent upon the rotation of the load shaft 40. Fixedly mounting the pressure plate 408 to the load shaft 404 prevents the pressure plate from rotating independent of the load shaft 404 during the braking process. If the pressure plate 408 rotated independent of the load shaft 404 during the braking process, the braking process would be compromised.

In one embodiment the first friction pad 420 and the second friction pad 424 are adhered to the ratchet disc 416. In another embodiment the first friction pad 420 and the second friction pad may be adhered to the pressure plate 408 and the plate gear 412, respectively. In alternative embodiments the first friction pad 420 and the second friction pad 424 may be adhered to any surface of the load brake assembly 400 that frictionally engages with another surface of the load brake assembly 400. In other embodiments the surfaces of the load brake assembly 400 that frictionally engage other surfaces of the load brake assembly 400 may include other frictional elements (not shown) as is generally known in the art.

The first friction pad 420 and the second friction pad 424 may include lubrication grooves 444 (e.g., a waffle pattern). One embodiment of the lubrication grooves 444 is illustrated on the side of the first friction pad 420 opposite the ratchet disc 416. The second friction disk 424 may also include lubrication grooves 444 on the side of the second friction disk 424 opposite the ratchet disc 416. Other surfaces of the load brake assembly may include lubrication grooves 444 and/or other lubrication structures to enhance movement of lubrication throughout the load brake assembly 400.

The plate gear 412 includes a hub 448 which defines the axis of the plate gear 412. The hub 448 is generally hollow and may be integral with or fixedly mounted to the plate gear 412. The hub 448 includes an axial movement device 452. In one embodiment the axial movement device 452 is a thread pattern that corresponds to acme threads 456 on the load shaft 404. The interaction between the plate gear 412 and the load shaft 404 is analogous to a "screw" and "nut" relationship.

The ratchet disc 416 is releasably coupled to a portion 456 of the plate gear 412 via a bushing 428 for axial movement in an axial direction (with respect to axis 406). As the plate gear 412 moves in an axial direction via the axial movement device 452, the ratchet disc 416 and the bushing 428 move along with the plate gear 412.

The load shaft 404 rotates about the axis 406 as the hoist drum 46 rotates in opposite wind-on and wind-off directions, respectively. The ratchet disc 416 is allowed to rotate when the hoist drum 46 rotates in the wind-on direction, however, the ratchet disc 416 is prevented from rotating when the hoist drum 46 rotates in the wind-off direction. The pawl 432 acts as a one-way switch that releasably engages the ratchet disc 416 when the hoist drum 46 rotates in the wind-off direction. Free rotation of the ratchet disc 416 in the wind-on direction eliminates any drag in the rotation of the hoist drum 46 associated with the load brake assembly 400. However, when the ratchet disc is releasably engaged by the pawl 432 in the wind-off direction, the load brake assembly 400 may perform the braking process.

The load brake assembly 400 performs the braking process by frictionally engaging surfaces of the load brake assembly 400. Specifically, the pressure plate 408 frictionally engages the first friction pad 420 attached to the ratchet disc 416 and the plate gear 412 frictionally engages the second friction pad 424 attached to the ratchet disc 416. The surfaces become frictionally engaged when the surfaces move axial closer to the corresponding frictionally engagable surface. The axial movement device 452 of the plate gear 412 provides such axial movement when the rotational speed of the plate gear 412 and the rotational speed of the load shaft 404 differ. If the axial movement provided is enough to result in frictional engagement of the corresponding frictionally engagable surfaces, the braking process is performed. When the operation of the gearbox 62 returns to steady state the plate gear 412 moves axially in the other direction thereby effectively removing the braking process.

When the braking process is performed, heat is generated. Excessive heat is undesirable because of adverse effects associated with lubrication degeneration and loss of braking process stability and/or integrity. The invention accordingly provides a self-lubricating load brake assembly 400 that provides cool lubrication to remove heat from the frictional surfaces of the load brake assembly 400.

The pressure plate 408 includes a plurality of lubrication inlet holes 460. In one embodiment the pressure plate 408 includes six equally spaced lubrication inlet holes 460. In other embodiments the pressure plate 408 includes more or less lubrication inlet holes 460. The lubrication inlet holes 460 are utilized to pump cool lubrication into the load brake assembly 400 to thereby remove heat from the frictional surfaces of the load brake assembly 400, Lubrication is pumped through the lubrication inlet holes 460 by the meshing action of a gear 463 and the pinion 436 wherein the meshing teeth of the gear 463 and the pinion 438 are aligned to interact with (i.e., pump lubrication through) the lubrication inlet holes 460. As is generally known, the meshing action of two gears located in a lubrication propels lubrication in a direction perpendicular to the tangential relationship between the two gears (i.e., the lubrication is directed at a ninety degree angle to the plane of the gears from the teeth of the two respective gears that are meshing). The lubrication inlet holes 460 are preferably positioned to accept the strongest part of the propelled lubrication.

After the lubrication has removed heat from the frictional surfaces of the load brake assembly 400, the hot lubrication is pumped out of the load brake assembly 400 through a plurality of lubrication outlet holes 464 located in the plate gear 412 and through the lubrication grooves 444. In one embodiment the plate gear 412 includes six equally spaced lubrication outlet holes 464. In other embodiments the plate gear 412 includes more or less lubrication outlet holes 464. The lubrication outlet holes 464 are angled radially outwardly through the thickness T of the plate gear 412 from the inlet 466 of the lubrication outlet holes 464 to the outlet 468 of the lubrication outlet holes 464. The outlets 468 of the lubrication outlet holes 464 travel at a higher rate of speed than the inlets 466 of the lubrication outlet holes 464 when the plate gear 412 is driven (i.e., the outlets 468 are located radially outward of the inlets 466, therefore the distance the outlets 468 travel is greater than the distance the inlets 466 travel in the same amount of time) thereby resulting in a pumping type action. The strategic placement of the lubrication inlet holes 460 in relation to the meshing gears allows the lubrication to in effect be pumped into the inner working of the load brake assembly 400. The strategic placement of the lubrication outlet holes 464 and the lubrication moving function of the lubrication grooves 444 further enhances the pumping like action of the lubrication through the load brake assembly 400 by allowing for the lubrication to be pumped out of the load brake assembly 400. The hot lubrication returns to the oil sump of the gearbox 62 where the heat is dissipated throughout the oil sump thereby regenerating the hot lubrication to cool lubrication.

Radially outwardly angled lubrication outlets 466 are preferred over lubrication outlets that are not radially outwardly angled because of the pumping type action that is provided by the radially outwardly angled lubrication outlets 466. Lubrication outlets that are not radially outwardly angled primarily utilize passive movement of the lubrication through the lubrication outlets. When utilizing passive movement of the lubrication the hot lubrication can get trapped in the areas between the structures corresponding to the pressure plate 412 and the plate gear 416. Thus, the frictional surfaces build up excessive heat and the problems associated with lubrication degeneration and loss of braking performance are experienced.

Two-Stage Gearbox

The gearbox 62*a* illustrated in FIGS. 5 and 6 includes a two-stage high gear ratio gear set 470. As illustrated in FIG. 6 the gearbox 62*a* also includes the load brake assembly 400. By definition a two-stage gear set includes two shafts with two gears per shaft (i.e., four gears). The space between the two shafts may be referred to as the center size of the gear set. The gears of a gear set commonly interact with other gears not including in the gear set (e.g., a pinion coupled to the output shaft 280 of the hoist motor 58). The combination of a gear located on one of the two shafts of the gear set which interacts with a second gear located on the other of the two shafts of the gear set or on another shaft not included in the gear set (e.g., output shaft 280) is known as a gear pair. High ratio gear sets typically employ one small gear (e.g., a pinion) and one large gear in each gear pair associated with the gear set. Such gear pair configurations are necessary to produce a high gear ratio. A precise design of the center size of the gear set in high ratio gear sets is necessary to ensure that the two gears of the gear pair spanning the two shafts mesh properly.

Hoist apparatuses typically employ multi-stage gear set (e.g., a three-stage or a four-stage gear set). An example of a three-stage gear set is illustrated in FIGS. 7A and 7B. Hoist apparatuses commonly necessitate high gear ratio gear sets which typically correspond to the multi-stage gear sets. High ratio gear sets typically correspond to multi-stage gear sets because for a constant gear ratio the difference in gear sizes in a gear pair lessens as more stages are utilized (i.e., when assuming a constant gear ratio, the gears of a gear pair become more similarly sized as the number of stages is increased). Difficulties associated with producing gear pairs that include non-similarly sized gears (e.g., a smaller pinion and a larger gear that mesh) as is required in a two-stage high gear ratio gear set have resulted in use of gear sets that include more gears than the invention utilizes to provide a gear ratio that is substantially similar to the gear ratio provided by a multi-stage gear set.

Inclusion of a load brake assembly in a gearbox further complicates the gearbox design (e.g., problems associated with the physical space available in the gearbox). It is generally desirous to include as large of a load brake assembly as possible in a gearbox design. Load brake assemblies are typically designed to be as large as possible to provide adequate braking. The large size of the load brake assembly complicates the spacing of the gear pairs (e.g., spacing of the center size) which are typically difficult to design without added complications.

Braking performance is typically increased when using a larger load brake assembly because the larger frictional surfaces included in the larger load brake assembly provide more efficient heat dissipation than the smaller frictional surface included in smaller load brake assemblies. Obviously, use of a smaller load brake assembly would alleviate some problems associated with incorporating a load brake assembly in a gearbox with a two-stage gear set. However, smaller load brake assemblies typically do not include braking performances adequate to ensure load stability and/or integrity (i.e., the brake torque provided is not adequate under all circumstances to stop a falling load). The load brake assembly 400 of the invention allows for use of a smaller sized load brake assembly that has a braking performance similar to a larger sized load brake assembly because of the enhanced heat dissipation provided by the self-lubrication feature. Without the use of a load brake assembly similar to the load brake assembly 400, the center size of a two-stage gear set would not accommodate a load brake assembly large enough to provide adequate braking performance.

The invention allows for the use of a load brake assembly while reducing the number of gears necessary, reducing the size of gearbox necessary, and thereby reducing the cost associated with acquiring a hoist apparatus.

Operational Data

Figure 14:
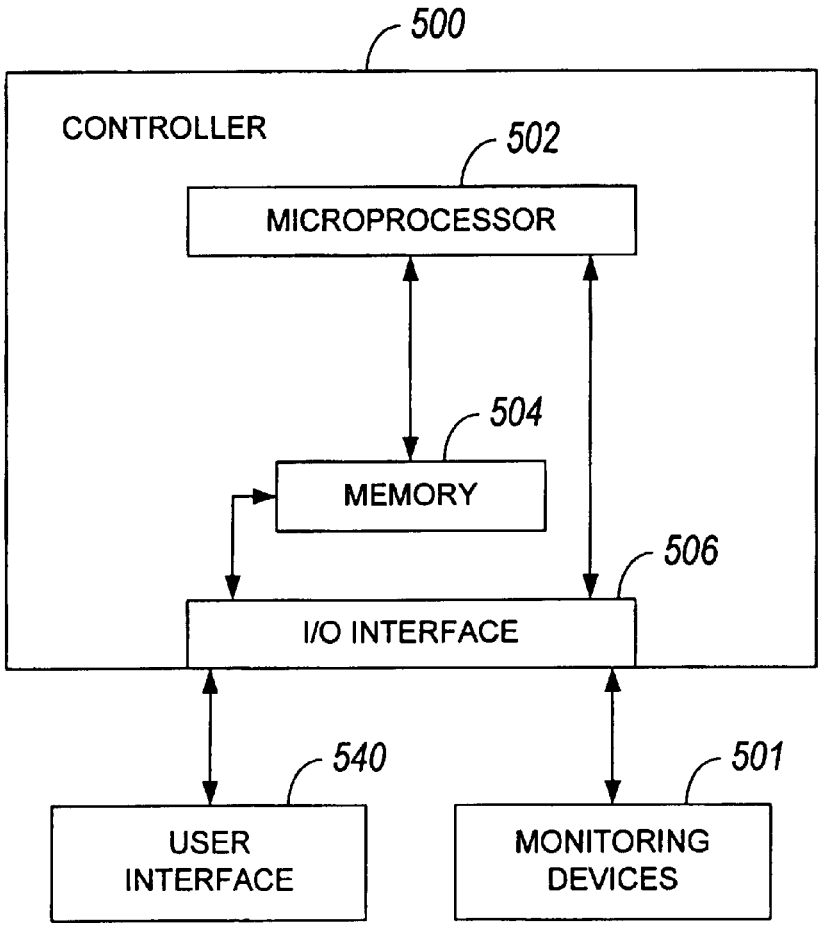
FIG. 14 illustrates a controller configured to analyze operational data of the hoist apparatus illustrated in FIGS. 1 and 2.

FIG. 14 illustrates a controller 500 configured to analyze operational data of the hoist apparatus 10 and to provide outputs to the hoist apparatus provider and/or the hoist apparatus operator. In one embodiment the controller 500 is housed in the control cabinet 70. Monitoring devices 501 associated with the controller 500 may be coupled to the hoist apparatus 10 in a plurality of locations. The controller 500 includes a microprocessor 502, a memory 504 and an input/output (I/O) interface 506, which are well known in the art. In other embodiments the controller 500 may include an application specific integrated circuit (ASIC), discrete logic circuitry or a combination of a microprocessor, an ASIC, and discrete logic circuitry. Of course, the controller 500 may include other components (e.g., drivers) not shown.

Figure 15:
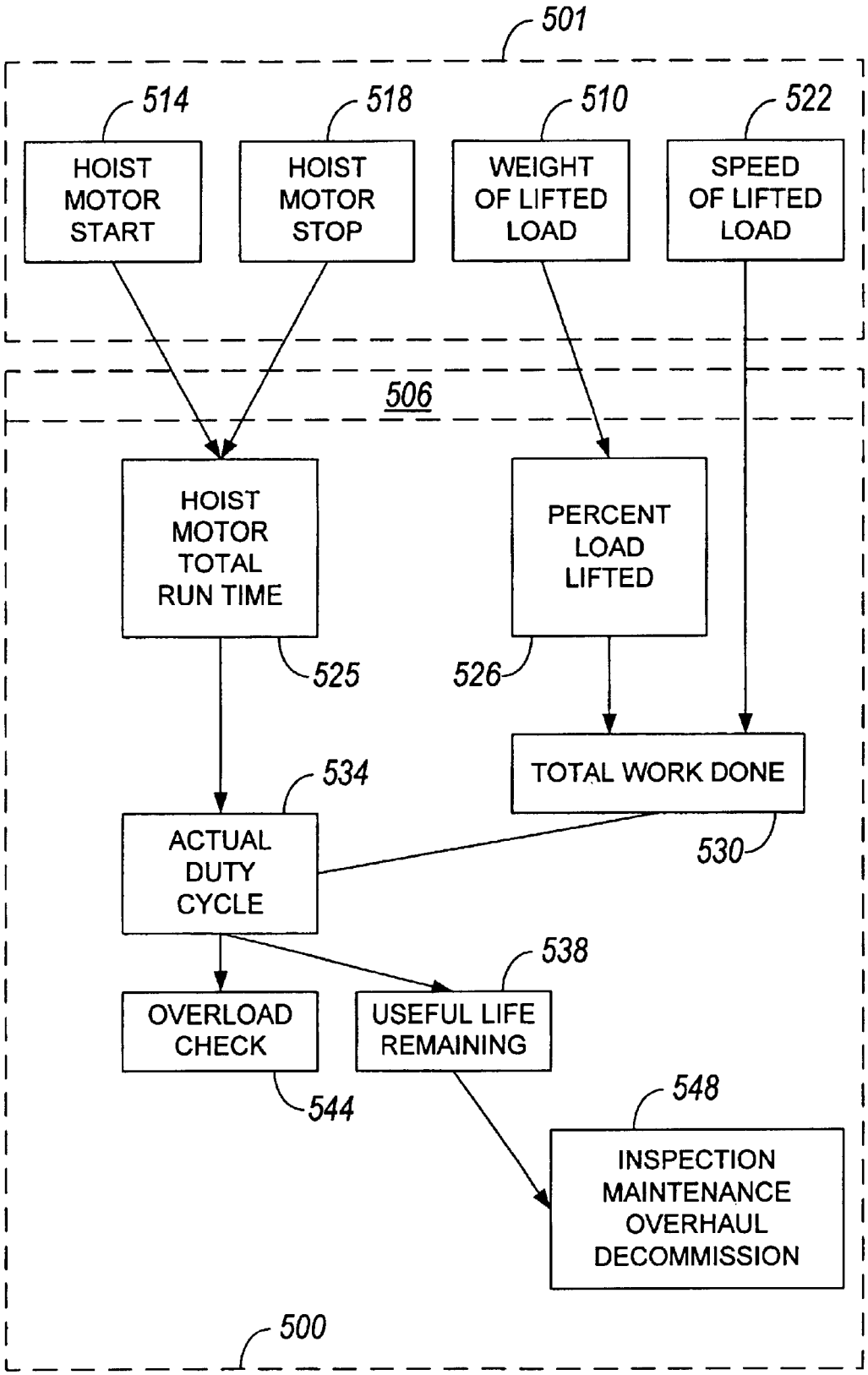
FIG. 15 illustrates a functional block diagram of the analysis performed by the controller illustrated in FIG. 14.

At power up of the controller 500, the microprocessor 502 obtains a software program from the memory device 504. The software program includes a plurality of instructions. The microprocessor interprets and executes the software instructions to analyze the operational data of the hoist apparatus 10 as is discussed below. A functional block diagram illustrating some of the functions of the controller 500 is illustrated in FIG. 15.

The controller 500 acquires operational data from the monitoring devices 501 via the I/O interface 506. The operational data may be acquired passively (i.e., receive a signal from the monitoring device 501) or actively (i.e., the monitoring device 501 is queried to provide operational data via the I/O interface 506). The operational data acquired includes, for example, a measurement of the weight of the load lifted 510, a measurement of hoist motor starts 514, a measurement of hoist motor stops 518, a measurement of the speed at which the load is lifted 522, and the like. The operational data may be stored in the memory 504 and/or delivered directly to the microprocessor 502 for processing in accordance with the software program.

The microprocessor 502 analyzes the operational data using the software program by performing a number of functions. The microprocessor 502 may perform the functions by using one or more equations and/or one or more look-up tables. One such function includes calculating a number of values. The values calculated may include, for example, a calculation of the percent load lifted 526, a calculation of the hoist motor total run time 525, a calculation of the total work done 530, a calculation of an actual duty cycle of the hoist apparatus 534, and a calculation of the useful remaining life 538 of the hoist apparatus 10 (and parts thereof), and the like. A value calculated by a first calculation may be required to complete other calculations.

The calculated values may be analyzed further and/or output to a user interface 540 for use by the hoist apparatus provider and/or the hoist apparatus operator. The user interface 540 may include any type of interface as is generally known in the art (e.g., graphical user interface, analog and/or digital meters, and the like). The user interface 540 may allow the user to access any data available on the controller 500 including raw operational data and processed operational data. Further analysis may include an overload check 544 where the actual duty cycle is compared to the theoretical duty cycle and an overload signal is generated when the actual duty cycle exceeds the theoretical duty cycle (i.e., the duty cycle the hoist apparatus is designed to perform), determination of when inspection, maintenance, overhaul and/or decommission of the hoist apparatus 10 needs to occur 548 based on a comparison of the remaining useful life 534 to industry standards for the expected life of the parts of the hoist apparatus 10, and the like.

Monitoring devices 501 are generally known in the art. An example of a monitoring device 501 is disclosed in U.S. Pat. No. 5,662,311, entitled "Lifting Apparatus Including Overload Sensing Device." Monitoring devices 501 include, for example, current sensors, strain sensors, timers, and the like. The measurement of the weight of the load lifted 510 is obtained using a monitoring device 501 that measures the mechanical strain on the hoist apparatus. In one embodiment the strain sensing monitoring device 501 is placed at the most critical mechanical stress area of the hoist apparatus 10. The measurement of hoist motor starts 514 and the measurement of hoist motor stops 518 are obtained through the use of a current sensing monitoring device 501. The current sensing monitoring device 501 essentially determines whether the hoist motor 58 is turned on or off. The measurement of the speed at which the load is lifted 522 may also be obtained using a current sensing monitoring device 501. The current the hoist motor 58 draws is typically proportional to how hard the hoist motor 58 is working. A higher current draw corresponds to a faster lift speed of the load when the load is constant. A sensor that counts the revolutions of the hoist drum 46 may also be utilized to measure the speed at which the load is lifted. A number of revolutions corresponds to a certain length of hoist rope 50 that is wound on to the hoist drum 46. This value in conjunction with a timer value can be utilized to calculate the lift speed. It should be understood that the operational data may be obtained from other types of monitoring devices. The monitoring devices 501 are merely described as examples of such monitoring devices.

When the operational data is acquired by the controller 500 via the I/O interface 506, the microprocessor 502 can perform the functions of the software program. The percent load lifted 526 is calculated by dividing the measured load lifted by the maximum load the hoist apparatus 10 is rated to lift. The maximum load the hoist apparatus 10 is rated to lift is determined when the hoist apparatus 10 is configured. The value of the maximum load the hoist apparatus 10 is rated to lift is stored in the memory 504. For example, if the hoist apparatus is rated to lift a load of ten tons, a load lifted of five tons is fifty percent of the maximum load that can be lifted. The hoist motor total run time 525 is calculated using a timer of the controller 500. In one embodiment the timer of the microprocessor is utilized to calculate the hoist motor total run time 525. The timer begins to increment when the hoist motor start signal 514 is received and ceases when the hoist motor stop signal 518 is received. In another embodiment, a monitoring device 501 may include a timer that generates a value of the total hoist motor run time. The total hoist motor run time would thereby be an input to the controller 500. The total run time is utilized to calculate the actual duty cycle of the hoist apparatus 10. Using the total run time allows for calculation of the distance the load travels. In one embodiment, using the speed at which the load is lifted 522 along with the duration the load is lifted allows for a determination of the distance through which the load traveled. The distance can be combined with the weight of the load lifted to calculate the total work done 530 using the hoist apparatus. The total work done value is also used in calculating the actual duty cycle of the hoist apparatus 10. The actual duty cycle of the hoist apparatus 534 is calculated to determine how the hoist apparatus is being utilized overall. This value is compared with a theoretical value of duty cycle (i.e., the duty cycle the hoist apparatus 10 is rated for) to determine if an overload condition exists 544. If an overload condition exists an overload counter is incremented. The hoist apparatus provider can view the overload counter to determine the number of times the hoist apparatus has been utilized improperly. If the number of improper uses exceeds a threshold value, the hoist apparatus provider may void the warranty of the hoist apparatus 10.

The useful remaining life 538 of the hoist apparatus 10 (and parts thereof) can be calculated using the actual duty cycle value. Industry standards provide expected life spans for most parts included on a hoist apparatus 10 based upon the type and the category of the hoist apparatus 10. The life spans assume that the hoist apparatus 10 is utilized in lifting applications the hoist apparatus 10 is rated to perform. If the actual duty cycle value indicates the hoist apparatus 10 has been used as intended, the remaining life likely is commensurate with the industry standards. The software program adjusts the value of remaining useful life based upon whether the hoist apparatus 10 is under or over utilized.

The remaining useful life value can then be utilized to determine when inspection, maintenance, overhaul and/or decommission of the hoist apparatus 10 needs to occur. The user may access time spans and or dates that indicate when such activity needs to occur by utilizing the user interface 540.

Inverter Control

Figure 16:
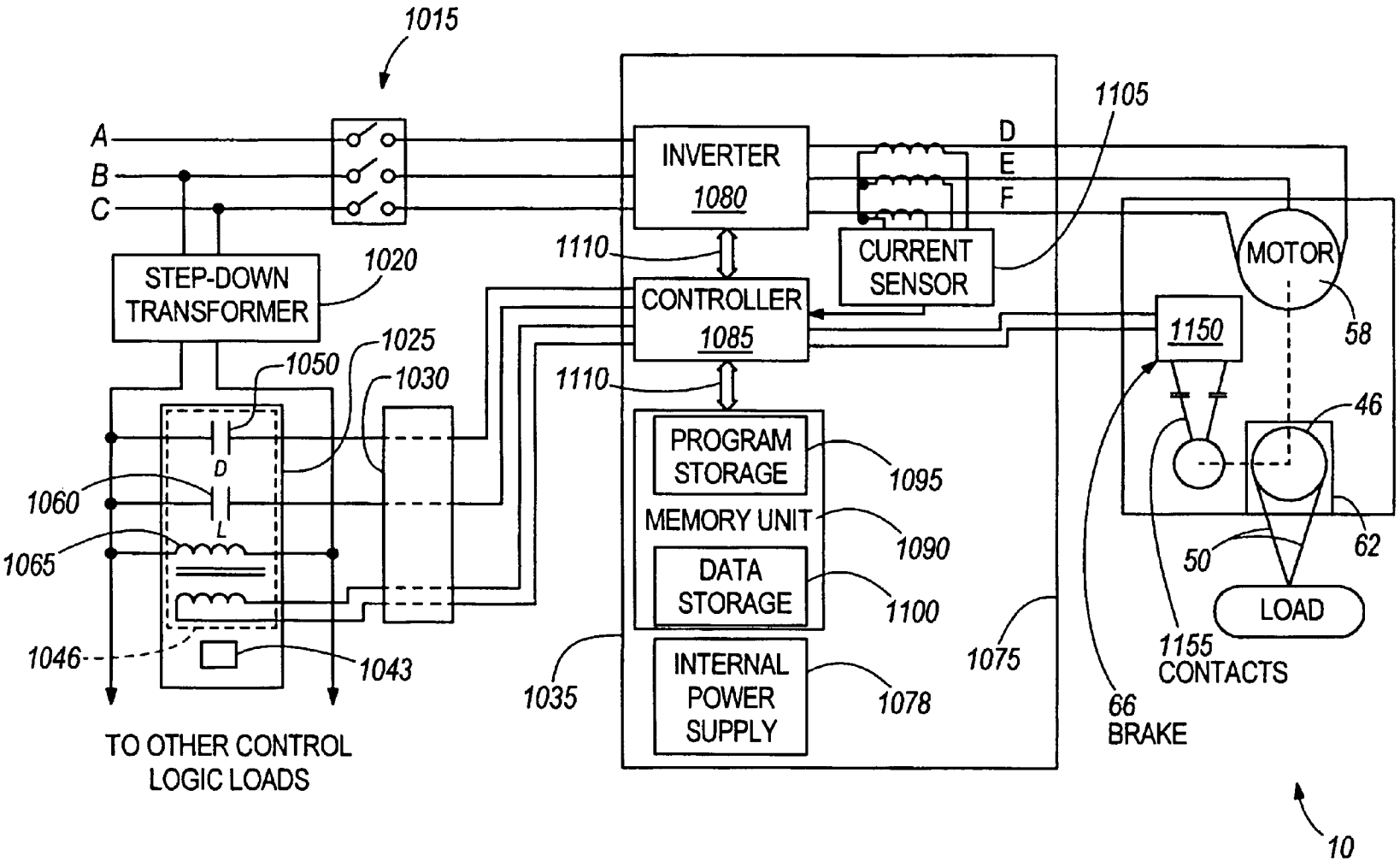
FIG. 16 is a block diagram of the hoist apparatus illustrated in FIGS. 1 and 2.

The hoist apparatus 10 is schematically shown in FIG. 16. The hoist apparatus 10 generally also includes a main switch 1015, a step-down transformer 1020, an operator input 1025, an interface 1030, and an adjustable frequency alternating current (AC) drive 1035.

The main switch 1015 controls the power provided to the adjustable frequency AC drive 1035. Upon closure of the main switch 1015, a fixed frequency signal (e.g., a 460V, 60 Hz, three-phase AC signal) is supplied from main-power lines A, B and C to the adjustable frequency AC drive 1035. Although, the embodiment described herein is for a 460V, 60 Hz, three-phase signal, other fixed frequency signals (e.g., a 120V, 60 Hz, single-phase signal) may be used.

The step-down transformer 1020 receives one phase of the fixed frequency signal, and "steps down" or reduces the voltage to a 120V signal. The 120V signal powers the operator input 1025. Of course, other voltages may be to power the operator input 1025.

The operator input 1025 allows an operator to control the hoist apparatus 10. The operator input 1025 includes a first input device 1043 (e.g., a push button, a switch, a key switch, etc.) that opens and closes main switch 1015, a second input device (e.g., a lever, a pedal, one or more switches, one or more push buttons, a keyboard, a keypad, etc.) for entering a directional command (e.g., a "raise" or "lower" command), and a third input device (e.g., a lever, a pedal, one or more switches, one or more push buttons, a keyboard, a keypad, etc.) for entering a speed command. Of course, other inputs may be added to the operator input 1025 (e.g., a safety shut-off input) or elsewhere. Additionally, the second and third input devices may be combined into one input device (e.g., a master switch or control 1046). For the remainder of the detailed description, it is assumed the second and third input devices are combined in a master switch (e.g., a master lever).

As shown in FIG. 16, the operator input 1025 further includes a first contact 1050 that closes in response to an operator moving the master switch towards a raise position. Closing the first contact 1050 generates a raise command that results in the hoist drum 46 rotating in the wind-on direction to raise a load. The operator input 1025 further includes a second contact 1060 that closes in response to an operator moving the master switch towards a lower position. Closing the second contact 1060 generates a lower command that results in the hoist drum 46 rotating in the wind-off direction to lower the load. Other devices or components may be used in place of the contacts 1050 and 1060 (e.g., solid state devices) that generate one or more directional signals indicating a desired load direction.

The operator input 1025 further includes a variable reluctance transformer 1065 that generates a low-voltage AC signal (e.g., a 0 to 16VAC signal) in response to an operator entering a desired speed into the master switch 1046. For example, if the operator is deflecting the master switch by a distance or amount, then the transformer 1065 generates a signal having a magnitude proportional to the amount of deflection. The resulting speed signal indicates a desired speed of the hoist motor 58. Other devices or components may be used in place of the transformer 1065 (e.g., solid state devices) for generating the requested speed signal.

The interface (e.g., an interface card) 1030 receives the plurality of inputs from the operator input 1025, and converts the inputs into a plurality of DC outputs. For example, the interface 1030 receives a low voltage AC signal from the transformer 1065, and converts the signal to a DC signal (e.g., a 0–10VDC signal). The DC signal is preferably proportional to the AC signal, and is provided to the adjustable frequency AC drive 1035. As a second example, upon one of the relays 1050 or 1060 closing, an AC signal is provided to the interface card 1030 which generates a DC output signal in response to the AC signal. The DC signal is then provided to the adjustable frequency drive 1035.

The adjustable frequency AC drive or power supply 1035 receives the fixed three-phase signal from the main power lines A, B and C, receives the directional signals from the interface 1030, receives the speed signal from the interface 1030, generates a current in response to the received directional signal and the speed signal, provides the current to the hoist motor 58, and provides a brake-control signal to the brake device 66. As shown in FIG. 16, the adjustable frequency AC power drive 1035 generally includes a housing 1075 that encloses an internal power supply 1078, an inverter 1080, a controller 1085, a memory unit 1090, a current sensor 1105, and a bus 1110. In one embodiment the adjustable frequency AC power drive 1035 may be housed in the control cabinet 70. For the description below, the current generated by the inverter 1080 may also be referred to as an inverter signal.

With reference to FIG. 16, the internal power supply 1078 receives power from an internal bus, and produces a low-voltage DC signal. The low-voltage DC signal powers the digital components of the adjustable frequency AC drive 1035.

The inverter 1080 receives the substantially fixed three-phase signal from main power lines A, B and C, and generates the three-phase inverter signal on lines D, E and F. The output or inverter signal is a three-phase AC signal having a selectively variable frequency $f_{out}$ and a pulse-width-modulated (PWM) DC voltage $V_{out}$. The PWM DC voltage $V_{out}$ includes voltage pulses that are provided to the stator coils of the hoist motor 58 (discussed below). The stator coils filter the voltage pulses, resulting in the inverter output current having a periodic AC (e.g., substantially sinusoidal) form. During operation, the inverter 1080 receives the three-phase power input, rectifies the power input to DC power, and inverts the DC power to generate the inverter signal at a constant voltage-to-frequency ratio. The inverter signal is varied and controlled by one or more control signals from the controller 1085 via bus 1110. The phase sequence, frequency and voltage of the inverter signal on lines D, E and F control the speed and direction of the hoist motor 58 and thereby the hoist drum 46 rotation.

The controller 1085 includes a microprocessor, a memory device and an input/output (I/O) interface, which are well known in the art. In other embodiments, the controller 1085 may include an application specific integrated circuit (ASIC), discrete logic circuitry or a combination of a microprocessor, an ASIC, and discrete logic circuitry. Of course, the controller 1085 may include other components (e.g., drivers) not shown.

With reference to FIG. 16, the controller 1085 obtains a software program having a plurality of instruction from the memory unit 1090, and interprets and executes the software instructions to control the hoist apparatus 10 as is discussed below. In general terms, the controller 1085 acquires the one or more direction inputs and the speed input from the interface 1030, and controls the inverter 1080 and the hoist motor 58 and thereby the hoist drum 46 in response to those inputs. Additionally, the controller 1085 receives an input from the current sensor 1105, receives data stored in the memory unit 1090 to perform at least one level of load integrity validation, and generates an output brake signal for the brake device 66 in response to or based upon the results of the load integrity validation. Of course, other inputs may be received or other outputs may be generated by the controller 1085 for implementing other aspects or features of the hoist apparatus 10 (e.g., an output provided to an operator display).

The memory unit 1090 includes a program storage memory 1095 and a data storage memory 1100. The program storage memory 1095 stores one or more software units or modules for operating the hoist apparatus 10. The data storage memory 1095 (e.g., an EEPROM) stores a model of the hoist motor 58 (discussed below) used by the software program for performing at least one level of load integrity validation. The model is previously recorded within the data storage memory 1100 before operation of the hoist apparatus 10. In one embodiment, the model is obtained by performing a static parameterization test, a dynamic parameterization test and a stepped-value parameterization test. The static parameterization test determines stator resistance, stator reactance, magnetizing current, rotor resistance and rotor reactance of the hoist motor 58 (discussed below) in a stationary state. The dynamic parameterization test determines stator resistance, stator reactance, magnetizing current, rotor resistance and rotor reactance of the hoist motor 58 in a rotating state. The stepped-value parameterization test determines stator resistance, stator reactance, magnetizing current, rotor resistance and rotor reactance of the hoist motor 58 rotating at various hoist motor speed levels. Once the three parameterization tests are performed, a model of the hoist motor 58 is created. The model may be in the form of one or more equations and/or may include one or more look-up tables. The controller 1085 uses the stored model, a commanded voltage (or frequency) of the inverter signal and a measured current to calculate a modeled value of a torque producing current (also referred to as a "modeled torque producing current"), and a hoist motor speed (also referred to as a "modeled hoist motor speed"). In addition, the controller 1085 uses the stored model, the commanded voltage (or frequency) of the inverter signal and a measured current to calculate an applied value of the torque producing current. Preferably, the model is unique for each hoist motor, but may be the same for a class of hoist motors. An example modeling system is a Morris Software System version 2.2.2 embedded in a Bulletin 425 brand inverter sold by Morris Material Handling, Inc. Further, other motor modeling systems or techniques may be used to obtain a modeled value of a torque producing current, a modeled value of a hoist motor speed and an applied value of the torque producing current.

The current sensor 1105 provides a DC signal proportional to the current of the inverter signal (i.e., the current from the inverter 1080 to the hoist motor 58). An example current sensor is a Hall-effect sensor sensing the current in all three lines D, E and F by conventional methods. Of course, other current sensors may be used and not all of the lines need to be measured.

In the embodiment shown, the hoist motor 58 is a squirrel-cage induction motor having a rated synchronous speed of 1200 revolutions-per-minute (RPM) at 60 Hz. However, other AC motors with other RPM's and base frequencies may be used with the invention. The hoist motor 58 receives the inverter signal from the adjustable frequency AC drive 1035 on lines D, E and F. Upon receiving the inverter signal, the hoist motor 58 drives the hoist drum 46 by use of the gear set in the gearbox 62 to rotate the hoist drum 46 in either the wind-on or wind-off direction. The rotational direction of the hoist motor 58 and, consequently, the raising and lowering of the load engaging device 54 is determined by the phase sequence of the inverter signal provided on lines D, E and F. By winding the hoist rope 50 onto or paying the hoist rope 50 off of the hoist drum 46, an object or load connected to the load engaging device 54 is raised or lowered. As used herein, the term "connection," and variations thereof (e.g., connect, connected, connecting, etc.), includes direct and indirect connections. The connection, unless specified, may be by mechanical, electrical, chemical, and/or electromagnetic means, or any combination of the foregoing (e.g. electro-mechanical).

The brake device 66 is a spring-set, electrically released brake connected to a rectifier 1150. Unless contacts 1155 are closed, the brake is spring-set to stop the assembly of the hoist motor 58 and gear set of the gearbox 62 from rotating. Upon the contacts 1155 closing, a current flows resulting in the brake device 66 releasing. The opening and closing of contacts 1155 is commanded by a brake-control signal from the controller 1085. The brake device 66 operates to hold the load suspended when the motor is not operating, and to prevent the load from becoming uncontrolled. Of course, other brake designs or braking systems may be used to stop and hold the hoist drum 46.

Figure 17:
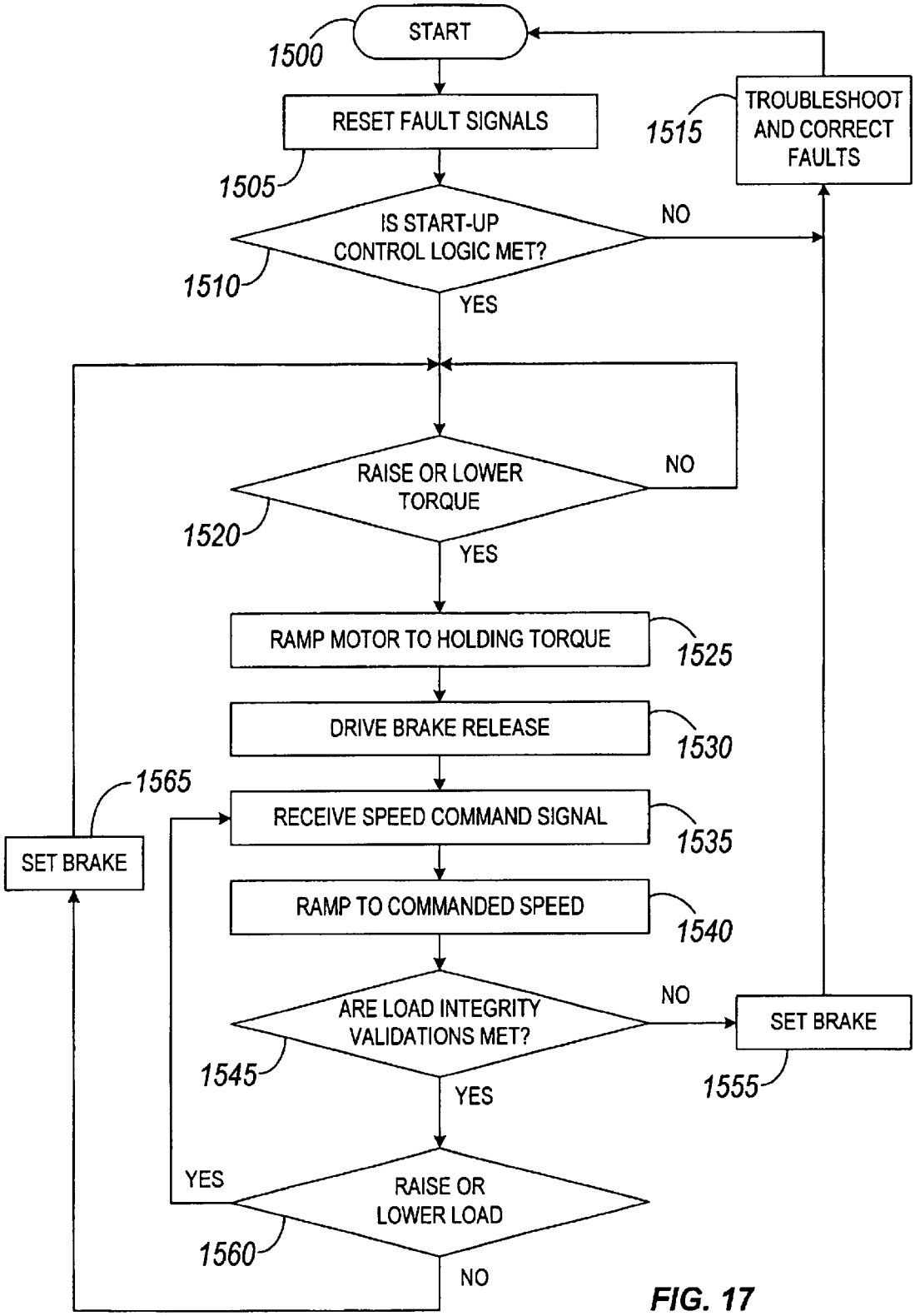
FIG. 17 is a flowchart of a method of operating the hoist apparatus illustrated in FIGS. 1 and 2.

FIG. 17 shows a method of operating the hoist apparatus 10. In operation and at act 1500, an operator initiates or starts the hoist apparatus 10 by controlling the first input device 1043 (e.g., presses a push button or turns a key switch). Starting the hoist apparatus 10 results in a fixed frequency and voltage signal being provided to the adjustable frequency AC drive 1035. For example, the operator may press a push button that results in the main switch 1015 closing. Additionally, power is provided to the operator input 1025. The operator input 1025 receives the power and generates a run engage or enable signal. The run-engage signal is provided to the controller 1085 via a run relay (not shown). Upon receiving the run enable, the controller 1085 loads one or more software units of the software program from program storage memory 1095, and runs the software program to operate the adjustable frequency AC drive 1035.

At act 1505, the operator input 1025 performs one or more internal logic checks and resets any drive faults that were previously stored during the last operation of the hoist apparatus 10. If the internal control logic is met (act 1510), then the operator input 1025 is operable to generate command signals (e.g., to generate raise, lower, and speed signals), and the method proceeds to act 1520. If the internal control logic is not met, then the software program proceeds to act 1515.

At act 1515, the hoist apparatus 10 does not begin operation or, if already operating, ceases operation. Upon ceasing operation, an operator may trouble shoot the hoist apparatus 10 to correct any system faults. To assist the operator, an error signal indicating the fault may be provided to the operator from the controller 1085.

At act 1520, an operator enters a direction command into the master switch 1046 of the operator input 1025. If the command is to raise the load, than first contact 1050 closes providing a signal to the controller 1085, via interface 1030. If the command is to lower the load, then the second contact 1060 closes providing a signal to the controller 1085, via the interface 1030. When the controller 1085 receives a direction command, the processor proceeds to act 1525. Alternatively, if the controller 1085 does not receive a direction command it continues to cycle through act 1520 until a signal is received or until the operator turns the system off.

At act 1525, the hoist motor 58 ramps to a maximum or holding torque. The holding torque is the maximum torque sufficient to hold the maximum rated load for the hoist apparatus 10 without using the brake device 66. To generate the holding torque, the controller 1085 controls the inverter 80, resulting in the hoist motor 58 receiving a current (i.e., the inverter signal). The current powers the hoist motor 58 such that the hoist motor 58 generates the holding torque. Once the controller 1085 determines the amount of torque being generated by the hoist motor 58 is sufficient to hold the load, then the controller 1085 proceeds to act 1530.

At act 1530, the controller 1085 provides a brake-control signal to the brake device resulting in the brake releasing. When the brake device 66 is released, the hoist motor 58 controls the load.

For acts 1535, 1540, 1545 and 1560, the controller 1085 continuously cycles through these acts until either act 1545 or act 1560 is not met. Although acts 1535, 1540, 1545 and 1560 are shown as discrete steps, one or more of the steps may be performed at the same time or in a different order. For example, for act 1540 (discussed below), the hoist motor 58 does not completely ramp up to the commanded speed before proceeding to act 1545. Rather, the hoist motor 58 ramps to the command speed while acts 1535, 1545 and 1560 are occurring.

At act 1535, an operator enters a speed command into the master switch of the operator input 1025. The speed command results in a variable AC signal being generated at transformer 1065. The variable AC signal is converted to a DC signal by interface 1030 and is provided to controller 1085.

At act 1540, the hoist motor 58 ramps to the commanded speed. One method for ramping to the commanded speed entails obtaining a current value from the current sensor 1105, and analyzing the current value. Based on the commanded speed, the sensed current and the modeled hoist motor, the controller 1085 determines whether the current value is too small or too large for the commanded speed. If the commanded speed is not met, then the controller 1085 varies the control signal provided to the inverter 1080 such that the phase sequence, frequency and voltage of the inverter signal results in a more expected current value.

At act 1545, the controller 1085 performs at least one load integrity validation check. That is, the controller 1085 determines whether the hoist motor 58 is operating within sufficient parameters to support or hold the load. If the load is secured, then the controller 1085 proceeds to act 1560. If the load is potentially not secured (i.e., lacks integrity) then the controller 1085 proceeds to act 1555.

Figure 18:
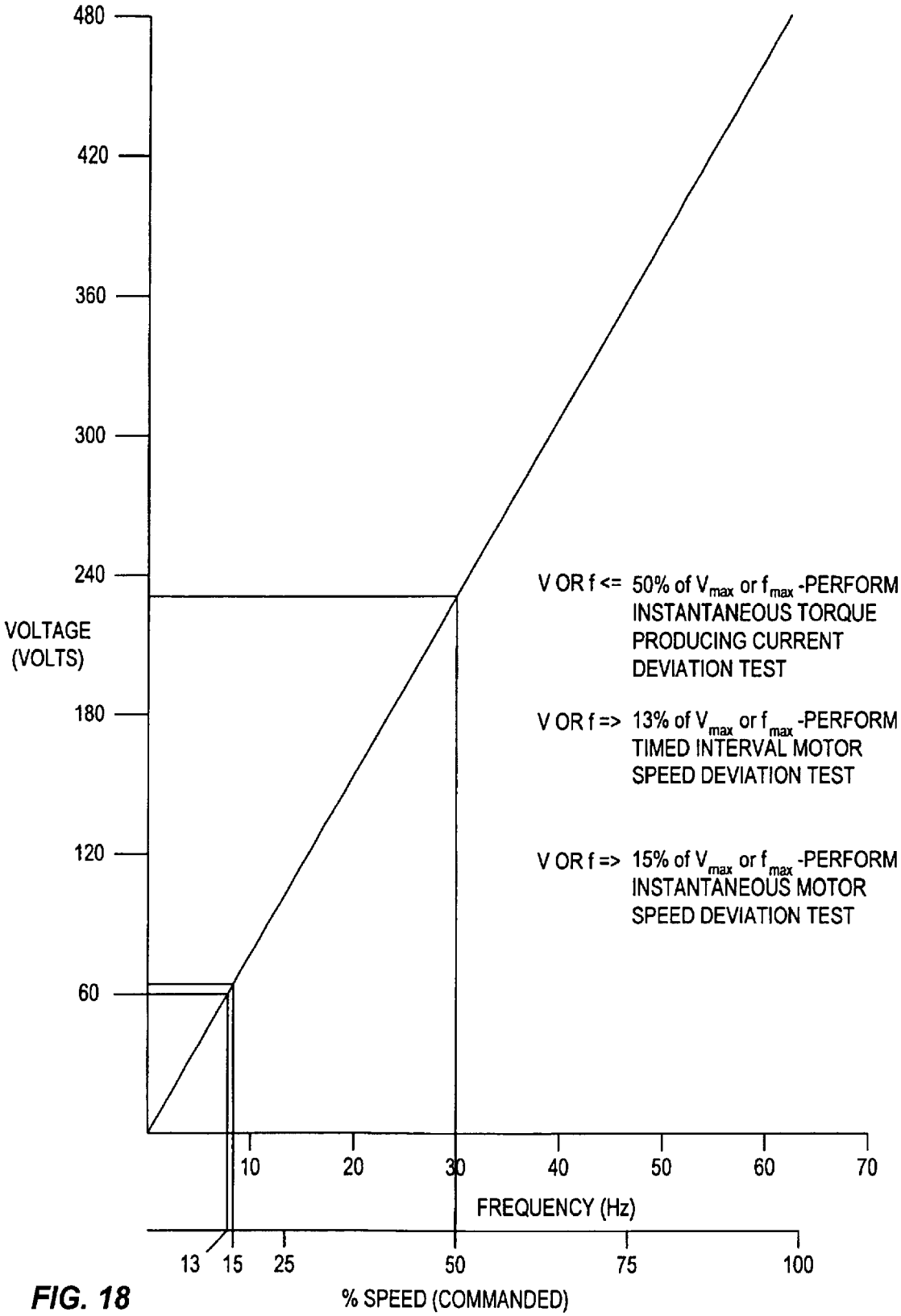
FIG. 18 is a chart representing the windows for performing the load integrity validation checks embodying the invention.

With reference to FIG. 18, for the preferred embodiment, the controller 1085 performs three load integrity tests or checks. The first check is an instantaneous torque producing current deviation test, the second check is a timed interval speed deviation test, and the third check is an instantaneous speed deviation test. The instantaneous torque producing current deviation test compares an applied torque producing current with a modeled torque producing current at an instance. The timed interval speed deviation test compares an actual hoist motor speed with a modeled hoist motor speed over a time period. The instantaneous speed deviation test compares the actual hoist motor speed with a modeled hoist motor speed at an instance. The software uses the frequency $f_{out}$ or the voltage $V_{out}$ of the inverter signal to determine when a particular load integrity test is conducted. For example and as shown in FIG. 18, the instantaneous torque producing current deviation test is performed when the inverter signal frequency $f_{out}$ is less than or equal to fifty percent of the rated frequency for the hoist motor 58 (e.g., less than or equal to 30 Hz for a 60 Hz motor). The instantaneous speed deviation test is performed when the applied frequency is equal to or greater than thirteen percent of the rated frequency for the hoist motor 58 (e.g., equal to or greater than 7.8 Hz for a 60 Hz motor). The timed interval speed deviation test is performed when the applied frequency is equal to or greater than fifteen percent of the rated frequency for the hoist motor 58 (e.g., equal to or greater than 9 Hz for a 60 Hz motor). For the embodiment described, the controller 1085 performs the torque producing current deviation test at lower frequencies since the instantaneous and incremental speed deviation tests are less valid at speeds below their window. However, the percentages disclosed may be changed. In addition, other load integrity tests may be performed. For example, the software may perform a timed interval torque producing current deviation test that compares an applied torque producing current with a modeled torque producing current over a time period.

Figure 19:
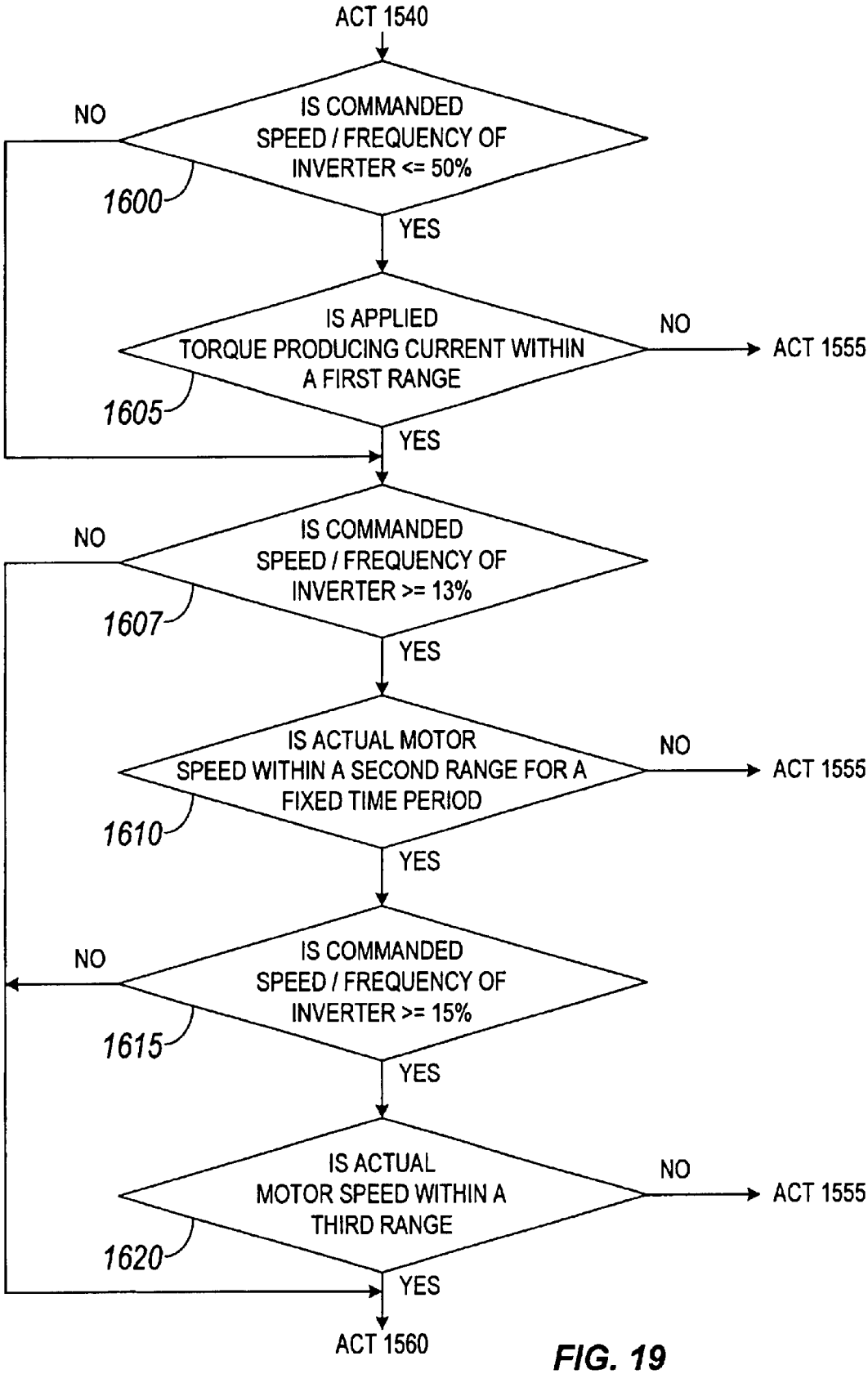
FIG. 19 is a flowchart of an exemplary method of determining if the load integrity validation checks are met embodying the invention.

One method for performing the three load integrity tests is shown in FIG. 19. At act 1600, the controller 1085 determines whether the commanded frequency of the inverter signal is less than or equal to fifty percent of the maximum frequency for the inverter signal (e.g., less than or equal to 30 Hz. for a 60 Hz. system). If the commanded frequency of the inverter signal is less then fifty percent, then the controller 1085 proceeds to act 1605 and performs the instantaneous torque producing current deviation test. If the commanded frequency of the inverter signal is greater then fifty percent, then the controller proceeds to act 1607 and does not perform the torque producing current deviation test. As was stated previously, fifty percent is an arbitrary number and may vary.

At act 1605, the controller 1085 performs the instantaneous torque producing current deviation test to determine whether an applied torque producing current value varies from a modeled torque producing current value by a first deviation amount or trip value (e.g., 20% of the modeled value). An example method for performing act 1605 is shown in FIG. 20.

Figure 20:
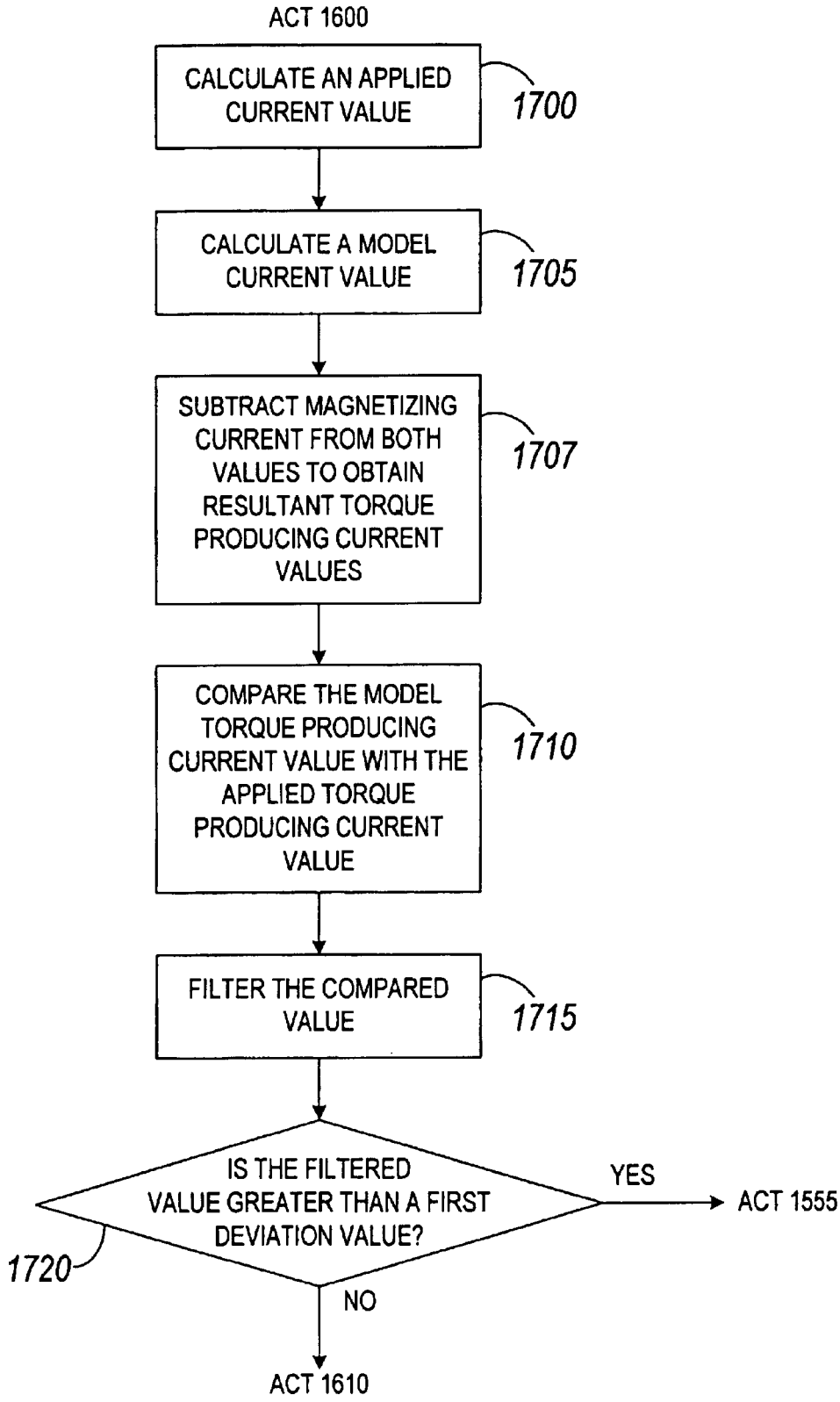
FIG. 20 is a flowchart of an exemplary method of determining if the applied torque producing current is within a first range embodying the invention.

With reference to FIG. 20 and at act 1700, the controller 1085 senses an applied current value $I_{out}$ from the current sensor 1105. The applied current value $I_{out}$ is a resultant current vector having a torque producing current vector and a magnetizing current vector.

At act 1705, the controller 1085 calculates a modeled current value $I_{model}$. The modeled current value $I_{model}$ is calculated from the stored model and is based upon the current $I_{out}$ and the voltage $V_{out}$ from the inverter 1080. For example, the controller 1085 may apply the current $I_{out}$ and voltage $V_{out}$ to one or more model equations to obtain the modeled current value $I_{model}$. The modeled current value $I_{model}$ is also a resultant current vector having a torque producing current vector and a magnetizing current vector.

At act 1707, the controller 1085 subtracts a magnetizing current value $I_{mag}$ from the modeled current value $I_{model}$ resulting in a modeled torque producing current value $I_{mtorque}$, and subtracts the magnetizing current value $I_{mag}$ from the applied current value $I_{out}$ resulting in an applied torque producing current value $I_{atorque}$. The magnetizing current value $I_{mag}$ is obtained from the stored model and is based upon the current $I_{out}$ and the voltage $V_{out}$.

At act 1710, the controller 1085 compares the applied torque producing current value $I_{atorque}$ to the modeled torque producing current value $I_{mtorque}$. One method for making this comparison is subtracting the applied torque producing current value $I_{atorque}$ from the modeled torque producing current value $I_{mtorque}$ and calculating an absolute value of the result.

At act 1715, a filter having a smoothing time constant filters the resulting compared value. That is, a continuous digital signal of the resulting absolute values is created and is filtered to remove unwanted high frequency noise that may result from a "jerking" of the load or from sensed noise. The filter may have a smoothing time constant of 0–50 ms with a preferred time constant of 5 ms.

At act 1720, the controller 1085 compares the resulting filtered value to a first deviation amount or trip value. If the filtered value is greater then the first deviation value, then the controller 1085 determines that the applied torque producing current value varies too much from the modeled torque producing current value and proceeds to act 1555. Otherwise, the controller 1085 determines the applied torque producing current value is within range and proceeds to act 1607.

Referring back to FIG. 4 and at act 1607, the controller 1085 determines whether the commanded frequency of the inverter signal is equal to or greater than thirteen percent of the max frequency for the inverter signal (e.g., greater than or equal to 7.8 Hz for a 60 Hz system). If the commanded frequency of the inverter signal is greater then thirteen percent, then the controller 1085 proceeds to act 1610 and performs the timed interval speed deviation test. If the commanded frequency of the inverter signal is less then thirteen percent, then the controller proceeds to act 1560 and does not perform the timed interval speed deviation test. As was discussed previously, thirteen percent is an arbitrary number and may vary.

Act 1610, the controller 1085 performs the timed interval speed deviation test to determine whether the actual (e.g., calculated) speed of the hoist motor varies from a modeled speed of the hoist motor by a second deviation amount (e.g., thirteen percent of the modeled value) for a fixed time period. If the controller 1085 determines that the actual speed of the hoist motor 58 varies from the modeled speed by a second deviation amount for a fixed time period, then the controller proceeds to act 1555. Otherwise, the controller proceeds to act 1615.

At act 1615, the controller 1085 determines whether the commanded frequency of the inverter signal is less than or equal to fifteen percent of the max frequency for the inverter signal (e.g., is less than 9 Hz. for a 60 Hz. system). If the commanded frequency of the inverter signal is greater than or equal to fifteen percent, then the controller proceeds to act 1620 and performs the instantaneous speed deviation test. If the commanded frequency of the inverter signal is less than fifteen percent, then the controller proceeds to act 1560 and does not perform the instantaneous speed deviation test. As was discussed previously, fifteen percent is an arbitrary number and may vary.

At act 1620, the controller 1085 performs the instantaneous speed deviation test to determine whether the actual (e.g., calculated) speed of the hoist motor 58 varies from a modeled speed of the hoist motor by a third deviation amount (e.g., fifteen percent of the modeled value). If the controller 1085 determines that the actual speed of the hoist motor has varied from the modeled speed of the hoist motor by a third deviation amount, then the controller 1085 proceeds to act 1555. Otherwise, the controller 1085 proceeds to act 1560. An example method for performing acts 1607, 1610, 1615 and 1620 is shown in FIG. 21.

Figure 21:
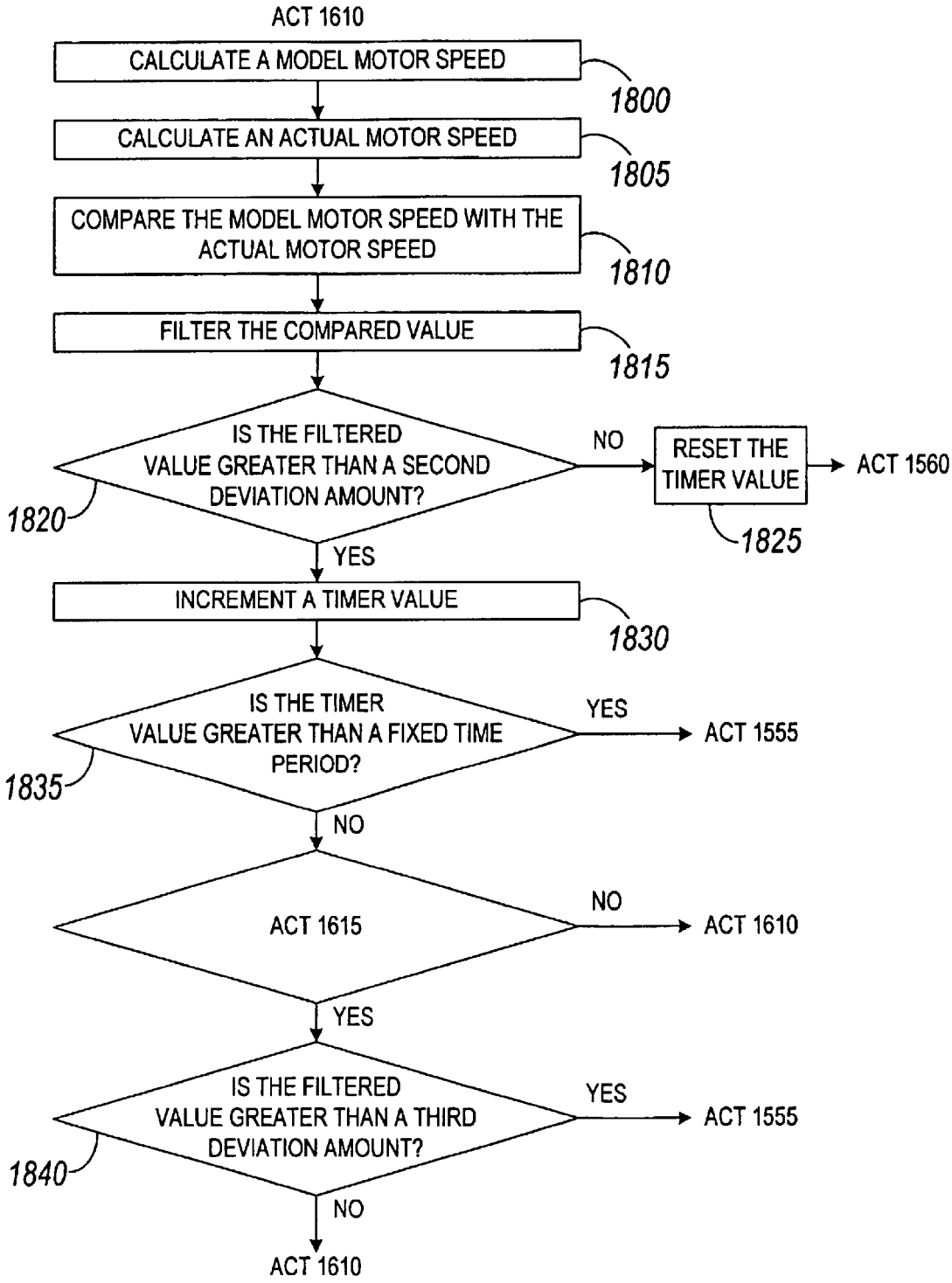
FIG. 21 is a flowchart of an exemplary method of determining if the actual hoist motor speed is within a second range for a fixed time period, and if the actual hoist motor speed is within a third range embodying the invention.

As shown in FIG. 21 and at act 1800, the controller 1085 calculates a modeled hoist motor speed. In one embodiment, the controller 1085 obtains from data storage memory 1100 an algorithm to calculate the modeled hoist motor speed from the commanded inverter signal. The modeled hoist motor speed is based on the frequency $f_{out}$, the voltage $V_{out}$, and the current $I_{out}$ of the inverter signal.

At act 1805, the controller 1085 calculates an actual or calculated hoist motor speed. In one embodiment, the controller 1085 obtains a measured current value from current sensor 1105. Based on the measured current value and the voltage $V_{out}$, the controller 1085 calculates an actual hoist motor speed as is known in the art.

At act 1810, the actual hoist motor speed is compared to the modeled hoist motor speed. One method for making this comparison is subtracting the actual hoist motor speed from the modeled hoist motor speed and calculating an absolute value of the result.

At act 1815, a filter having a smoothing time constant filters the resulting compared value. That is, a continuous digital signal of the compared absolute value is created and is filtered to remove high frequency noise. The filter may have a smoothing time constant between 0 ms and 100 ms with a preferred time constant of 0 ms (i.e., no filtering is performed).

At act 1820, the controller compares the resulting filtered speed value to a second deviation amount or trip value. If the filtered value is greater then the second deviation amount, then the controller 1085 determines the actual hoist motor speed potentially varies too much from the modeled hoist motor speed and proceeds to act 1830. If the resulting filtered value is less than the second deviation amount, then the controller 1085 proceeds to act 1825. At act 1825, the controller 1085 resets a first timer value (discussed in act 1830) to zero and proceeds to act 1560.

At act 1830, the controller 1085 increments a first timer value. The first timer value represents a period of time that the filtered value is larger than the second deviation amount. If the first timer value is equal to or greater than a time period (act 1835), then the controller 1085 determines the load may lack integrity and proceeds to act 1555. For example, the time period may be between 0 ms and 1 s is with a preferred time period of 500 ms. If the incremental timer is less then the time period, then the controller proceeds to act 1615.

At act 1840, the controller 1085 compares the resulting filtered value to a third deviation amount or trip value. If the filtered value is greater then the third deviation amount, then the controller 1085 determines the actual motor speed varies too much from the modeled motor speed and proceeds to act 1555. If the resulting compared value is less than the third deviation amount, then the controller 1085 proceeds to act 1610.

At act 1555, the controller 1085 generates an output that sets the brake device 66. For the embodiment disclosed, the controller 1085 removes the brake-control signal or sets the signal to 0VDC, resulting in the brake setting. Other methods may be used to set the brake device 66.

At act 1560, the controller 1085 determines whether a direction signal is being provided to the controller 1085. If a direction signal is still present (i.e., an operator is requesting the controller to raise or lower the load), then the controller returns to act 1535. If no direction signal is present, then the controller 1085 activates the brake (act 1565) and proceeds to act 1520.

Thus, the invention provides, among other things, a new and useful hoist apparatus and method of operating the same. Various features and advantages of the invention are set forth in the following claims.

What is claimed is:

1. A hoist apparatus comprising:

a frame;

a hoist drum supported by the frame for rotation about a hoist drum axis;

a hoist motor supported by the frame for selectively rotating the hoist drum in opposite wind-on and wind-off directions about the hoist drum axis;

a hoist rope wound around the hoist drum such that the hoist rope winds on to and off of the hoist drum in response to rotation of the hoist drum in the wind-on and wind-off directions, respectively;

a gearbox coupled to the hoist motor, the gearbox including an output shaft;

a ring gear external to the gearbox, wherein the ring gear is coupled to the hoist drum for selectively rotating the hoist drum in opposite wind-on and wind-off directions about the hoist drum axis in response to the hoist motor; and an adapter plate coupled to the gearbox, the adapter plate permitting a pinion coupled to the output shaft to drivingly engage the ring gear with the gearbox in a plurality of orientations relative to the frame.

2. A hoist apparatus as set forth in claim 1, and further comprising a support pin, wherein the support pin is coupled to the adapter plate, and wherein the support pin is configured to support one end of the hoist drum.

3. A hoist apparatus as set forth in claim 1, wherein the ring gear is configured to mesh with an output pinion coupled to an output shaft of the gearbox for selectively rotating the hoist drum in opposite wind-on and wind-off directions about the hoist drum axis in response to the hoist motor.

4. A hoist apparatus as set forth in claim 1, wherein the frame includes at least two mounting holes adapted to accept at least two fasteners coupled to the adapter plate.

5. A hoist apparatus as set forth in claim 4, wherein the adapter plate includes a plurality of sets of fastener holes, wherein each set of fastener holes corresponds to the at least two mounting holes, wherein each set of fastener holes is configured for use in mounting the adapter plate to the frame.

6. A hoist apparatus as set forth in claim 4, wherein the at least two mounting holes includes four mounting holes.

7. A hoist apparatus as set forth in claim 1, wherein the frame includes at least one cutout to accept a profile of the hoist motor when mounted in at least one of the plurality of orientations.

8. A hoist apparatus as set forth in claim 1, wherein the plurality of orientations includes four orientations.

9. A hoist apparatus as set forth in claim 1, wherein the adapter plate includes a plurality of sets of fastener holes, wherein each set of fastener holes corresponds to the at least two mounting holes.

10. A hoist apparatus as set forth in claim 1, and further comprising:

a three-part bottom block supported by the hoist rope such that the three-part bottom block travels up and down in response to rotation of the hoist drum in the wind-on and wind-off directions, respectively, wherein the three-part bottom block includes a cross shaft and at least one running sheave rotatably supported by the cross shaft, wherein the hoist rope is dead-ended on the cross shaft, a proximity limit switch wherein the proximity limit switch is mounted on the frame adjacent the hoist drum such that the hoist drum moves relative to the proximity limit switch, to proximity limit switch sensing at least one of the presence and the absence of the hoist rope without touching the hoist rope, and the proximity limit switch preventing the hoist motor from rotating the hoist drum in one of the wind-on direction when the switch senses the presence of the hoist rope on the hoist drum at the maximum wind-on point and the wind-off direction when the proximity limit switch senses the absence of the hoist rope on the hoist drum at to maximum wind-off point, a controller configured to analyze operational data and generate an output indicative of a remaining useful life of the hoist apparatus, wherein the controller includes a memory, a microprocessor, and an input and output interface, wherein the input and output interface is adapted to acquire operational data representative of the hoist apparatus and provide the operational data to at least one of the memory for storage and the microprocessor for processing, wherein the operational data includes at least one of a measurement of load weight a measurement of hoist motor starts, a measurement of hoist motor stops, and a measurement of a lift speed, wherein the microprocessor is adapted to generating a value based on the operational data, wherein the value includes at least one of a percent load lifted, hoist motor total run time, total work done, actual duty cycle of the hoist apparatus, and useful remaining life of the hoist apparatus, and wherein the microprocessor is adapted to communicate with a user interface via the input and output interface, the communication including communication of the output to the user interface, and an inverter, a current sensor, and an inverter controller, wherein the inverter is electrically connected to the hoist motor and configured to generate an inverter signal that drives the hoist motor, wherein the current sensor is configured to sense a current of the inverter signal and to generate a current signal having a relationship to the sensed current, and wherein the inverter controller is configured to receive the current signal, determine a modeled value of the hoist motor based in part on the current signal, compare an actual value of the hoist motor to the modeled value of the hoist motor for determining whether a load coupled to the hoist apparatus is stable, and generate an output that sets a brake device when the load coupled to the hoist apparatus is potentially unstable, wherein the gearbox includes a gear and a load brake assembly, the load brake assembly having a load shaft supported by the gearbox for rotation, wherein the load shaft includes a first end and a second end, a pinion coupled to the first end of the load shaft, wherein the pinion meshes with the gear, a pressure plate coupled to the first end of the load shaft inboard of the pinion, wherein the pressure plate includes a plurality of lubrication inlet holes, the lubrication inlet holes aligned to receive lubrication propelled by the meshing action of the pinion and the gear, a plate gear coupled to the second end of the load shaft, the plate gear including a first side nearest the first end of the load shaft and a second side nearest the second end of the load shaft, wherein the plate gear includes a plurality of lubrication outlet holes, the lubrication outlet holes being angled radially outwardly from the first side of the plate gear to the second side of the plate gear, and a ratchet disc located between the pressure plate and the plate gear.

11. A hoist apparatus as set forth in claim 1, and further comprising a three-part bottom block supported by the hoist rope such that the three-part bottom block travels up and down in response to rotation of the hoist drum in the wind-on and wind-off directions, respectively, wherein the three-part bottom block includes a cross shaft and at least one running sheave rotatably supported by the cross shaft, wherein the hoist rope is dead-ended on the cross shaft.

12. A hoist apparatus as set forth in claim 1, and further comprising a proximity limit switch wherein the proximity limit switch is mounted on the frame adjacent the hoist drum such that the hoist drum moves relative to the proximity limit switch, the proximity limit switch sensing at least one of the presence and the absence of the hoist rope without touching the hoist rope, and the proximity limit switch preventing the hoist motor from rotating the hoist drum in one of the wind-on direction when the switch senses the presence of the hoist rope on the hoist drum at the maximum wind-on point and the wind-off direction when the proximity limit switch senses the absence of the hoist rope an the hoist drum at the maximum wind-off point.

13. A hoist apparatus as set forth in claim 1, wherein the gearbox includes a gear and a load brake assembly, the load brake assembly having a load shaft supported by the gearbox for rotation, wherein the load shaft includes a first end and a second end, a pinion coupled to the first end of the load shaft, wherein the pinion meshes with the gear, a pressure plate coupled to the first end of the load shaft inboard of the pinion, wherein the pressure plate includes a plurality of lubrication inlet holes, the lubrication inlet holes aligned to receive lubrication propelled by the meshing action of the pinion and the gear, a plate gear coupled to the second end of the load shaft, the plate gear including a first side nearest the first end of the load shaft and a second side nearest the second end of the load shaft, wherein the plate gear includes a plurality of lubrication outlet holes, the lubrication outlet holes being angled radially outwardly from the first side of the plate gear to the second side of the plate gear, and a ratchet disc located between the pressure plate and the plate gear.

14. A hoist apparatus as set forth in claim 1, wherein the gearbox includes a gear and a load brake assembly, the load brake assembly having a load brake assembly and a two-stage high performance gear set.

15. A hoist apparatus as set forth in claim 1, and further comprising a controller configured to analyze operational data and generate an output indicative of a remaining useful life of the hoist apparatus, wherein the controller includes a memory, a microprocessor, and an input and output interface, wherein the input and output interface is adapted to acquire operational data representative of the hoist apparatus and provide the operational data to at least one of the memory for storage and the microprocessor for processing, wherein the operational data includes at least one of a measurement of load weight, a measurement of hoist motor starts, a measurement of hoist motor stops, and a measurement of a lift speed, wherein the microprocessor is adapted to generating a value based on the operational data, wherein the value includes at least one of a percent load lifted, hoist motor total run time, total work done, actual duty cycle of the hoist apparatus, and useful remaining life of the hoist apparatus, and wherein the microprocessor is adapted to communicate with a user interface via the input and output interface, the communication including communication of the output to the user interface.

16. A hoist apparatus as set forth in claim 1, and further comprising an inverter, a current sensor, and an inverter controller, wherein the inverter is electrically connected to the hoist motor and configured to generate an inverter signal that drives the hoist motor, wherein the current sensor is configured to sense a current of the inverter signal and to generate a current signal having a relationship to the sensed current, and wherein the inverter controller is configured to receive the current signal, determine a modeled value of the hoist motor based in part on the current signal, compare an actual value of the hoist motor to the modeled value of the hoist motor for determining whether a load coupled to the hoist apparatus is stable, and generate an output that sets a brake device when the load coupled to the hoist apparatus is potentially unstable.

* * * * *